US009284959B2

(12) United States Patent
Grigg

(10) Patent No.: US 9,284,959 B2
(45) Date of Patent: Mar. 15, 2016

(54) PROPULSION TURBINE

(71) Applicant: Charles Ronald Grigg, Westport, CA (US)

(72) Inventor: Charles Ronald Grigg, Westport, CA (US)

( * ) Notice: Subject to any disclaimer, the term of this patent is extended or adjusted under 35 U.S.C. 154(b) by 538 days.

(21) Appl. No.: 13/854,100

(22) Filed: Mar. 31, 2013

(65) Prior Publication Data

US 2014/0086749 A1 Mar. 27, 2014

Related U.S. Application Data

(63) Continuation-in-part of application No. 13/628,064, filed on Sep. 27, 2012, now abandoned.

(60) Provisional application No. 61/539,471, filed on Sep. 26, 2011.

(51) Int. Cl.
*F04D 13/02* (2006.01)
*F04D 33/00* (2006.01)

(52) U.S. Cl.
CPC ..... *F04D 13/028* (2013.01); *F04D 33/00* (2013.01)

(58) Field of Classification Search
CPC ..... F04D 13/028; F04D 33/00; F03D 3/068; F03D 3/02; F05B 2240/40
See application file for complete search history.

(56) References Cited

U.S. PATENT DOCUMENTS

2002/0153449 A1* 10/2002 Hatzistelios ..... B64C 39/00 244/12.2
2011/0012361 A1* 1/2011 Lee ..... B60K 7/00 290/55
2011/0076144 A1* 3/2011 Lucas ..... F03B 17/067 416/79

* cited by examiner

*Primary Examiner* — Valentina Xavier

(57) ABSTRACT

A turbine creating fluid displacement or thrust having an outer frame superstructure comprised of opposed disk assemblies extending parallel, each joined concentrically to a central sun gear and central drive shaft housing, each spaced apart along a central axis defining an interior operating space to support a motor driven driveshaft joined to a rotatable interplanetary assembly that secures two or more orbiting evenly spaced planetary turbines by bearing means each having a pivoting wing/s which presents a maximum contact surface profile in drive maximally impinging on air or water and pivoting back to a position of least resistance in glide thereby creating current or thrust, each made to counter rotate, once around its axis as the interplanetary assembly rotates once around the propulsion turbine's central axis, each maintaining a transverse planetary turbine and wing orientation relative to the direction of created thrust or fluid displacement.

16 Claims, 36 Drawing Sheets

A101 TYPES

A107

A106

A108

A203

A101

TYPE TWO

TYPE "4"

TYPE "3"

PROPULSION TURBINE

CROSS-REFERENCE TO RELATED APPLICATIONS

This application claims the priority date benefit of the U.S. provisional application No. 61/539,471, submitted Sep. 26, 2011, and U.S. patent application Ser. No. 13/628,064, filed Sep. 27, 2012.

BACKGROUND OF THE INVENTION

The Propulsion Super-turbine evolved from its predecessor the "turbine motor". The turbine motor powered by the natural current forces of wind or water is the feature of Grigg's U.S. Ser. No. 12/657,136. Unlike the earlier invention the Propulsion Turbine, the subject of this application, is a winged propeller or fan powered by a manmade force to create thrust or current, to move it and/or its attached assembly through air or water, or to be used as a fan to create fluid current.

BRIEF HISTORY

The Propulsion Turbine is an evolutionary relative of its predecessor the wind and water turbine Generator/motor, henceforth referred to as turbine motor, as described in Charles Grigg's previous provisional and utility U.S. Provisional patent application, including Provisional 61/382,346 dated Sep. 13, 2010 and U.S. application Ser. No. 12/657,136, dated Jan. 13, 2010, and PCT Application, and shares many of the same parts and mechanical features. The evolutionary nature of the research of this classification of turbines with hinged articulating wings has produced a variety of both turbine motors that are moved by natural wind and water currents and propulsion turbines and fans that are powered by motors. They share a version of many of the same part and many of the same movement dynamics having such common features as articulating opposing wings rotatable about their respective pivot axis from a drive position in which said wing/s extend to a position transverse to the ambient fluid or current to maximally impinge with said fluid or current, and pivot back to a glide feathered parallel position of least resistance assuming a minimum contact profile of minimum drag resistance.

Adapting the turbine motor that is driven by the natural forces of wind and water to a motorized propulsion system with winged propeller fans that move wind or water and/or it, and its attachments through the natural elements of air or water presented one major design problem, specifically creating a machine that keeps the drive stop assembly from blocking the The Turbine Motor: As a natural consequence of 180° of rotation into its glide position the drive stop of each wing of the turbine motor naturally changes sides relative to the incident current assuming a position between the wing and the current, thereby allowing the wing to collapse closed in glide to a profile of least resistance in the oncoming current.

A propulsion turbine that moves current instead of being moved by current pushes the ambient fluid with its drive stops behind the wing bracing the wing. If it were to rotate 180° its relationship to that side of the wing would be unchanged thereby blocking the wing from freely pivoting down to a position of least resistance in glide. The solution to this problem led to the propulsion turbine of this application which features an interplanetary positioning assembly that holds a plurality of evenly spaced independent rotating planetary turbines that rotate once around their main shaft as the interplanetary positioning assembly counter-rotates once around the propulsion turbine's central driveshaft keeping all its drive wings and planetary turbines always facing forward in a fixed orientation relative to the displacement of fluids and always in an opposite facing orientation relative to created thrust, with its drive stops always behind their respective wings bracing the wing in drive and always in an unchanged position relative to the wing letting each wing freely fall away into their glide position of least resistance.

NOMENCLATURE

Models of Propulsion Turbines

The propulsion turbine is comprised of an outer frame superstructure joined concentrically to a rotating central drive shaft that is joined to an interplanetary hub assembly that secures in an evenly spaced manner a plurality of orbiting planetary turbines each with pivoting opposed wings that open and close. The orientation of the wing's pivot axis within its planetary turbine relative to the propulsion turbine's central drive shaft defines the type of a planetary turbine.

In this document four such types are featured:

Type one—The opposed wings of each of the two pivot axes are centrally placed within to the interior space of the planetary turbine with said pivot axes perpendicular to the propulsion turbine's central drive shaft.

Type two—The opposed wing of each of the two pivot axes are decentralized within the interior space of the planetary turbine with said pivot axes perpendicular to the propulsion turbine's central drive shaft.

Type three—The opposed wings of each of the two pivot axes are centrally placed within the interior space of the planetary turbine with said pivot axes parallel to the propulsion turbine's central drive shaft.

Type four—The opposed wings of each of the two pivot axis are decentralized in the interior space of the planetary turbine with said axes parallel to the propulsion turbine's central drive shaft.

There are also two classes of propulsion turbines featured as design examples in this application. The relationship of the wings concentric sweep vector relative to the direction of created current or crafts trajectory determines the classification of propulsion turbines:

Class "A" propulsion turbine with planetary turbines having their wing's concentric sweep vector perpendicular to the created current or the craft's trajectory.

Class "B" propulsion turbines with planetary turbines having their wing's concentric sweep vector parallel to the created current or the crafts trajectory.

BRIEF SUMMARY OF THE INVENTION

The present invention generally comprises a current or thrust producing turbine designed to maximizes the frontal contact area and displace a large fraction of the ambient fluid, air or water, in its operating space, converting the resistance of that fluid into current or thrust. The unique construction of the propulsion turbine thus yields a more efficient turbine thruster or fan that is adaptable to many uses some of which will be described below.

Note that although this initial description relates to propulsion turbines it applies equally as a device used to create current when used in the capacity of a fan or as a pump or propeller when used in or under water.

This propulsion turbine is comprised of a plurality of planetary turbines that orbit around a stationary sun gear in side of the unobstructed sweep area provided within the turbine's superstructure. The propulsion turbine includes an outer framed super structure joined concentrically to the inter-stationary drive shaft housing assembly and central sun gear. The outer frame super structure includes a pair of end disk assemblies extending parallel and spaced apart along the central axis of said central driveshaft housing and sun gear creating a defined interior space for the operation of the orbiting planetary turbines within.

Joined at the center of each of the super structure's two disk assemblies is a stationary central bearing housing that holds, by bearing means, a central drive shaft joined to an interplanetary hub assembly that rotates about the propulsion turbine's central axis between the super structure's two end disc assemblies. The rotatable interplanetary hub assembly is comprised of two opposing hub structures each joined concentrically to said drive shaft, each said hub structure extending parallel to the other each spaced apart on the central axis of said central driveshaft.

Each opposing hub structure often has spoke-like arms that radiate out from said central drive shaft, each extending parallel to the other and each arm arranged concentrically at evenly spaced intervals around the circumference containing each hub structure. At the extension of each opposing arm of each opposed hub structure is a bearing housing and bearing in mutual vertical alignment with the opposing hub structure, this relationship thereby defining the central axis of the respective planetary turbine about which a planetary turbine will rotate. The arms of each opposing hub structure are concentrically and cylindrically aligned, with said bearings and bearing housings corresponding to said defined planetary turbine axis.

Between each pair of the hub's opposing arms is secured, by bearing means, a rotatable planetary turbine, concentrically arranged and held apart from one another, by opposing arms of the interplanetary hub assembly, the interplanetary hub assembly holding each rotating planetary turbine in an evenly spaced manner, allowing each planetary turbine to rotate independent of the other, in its own operating space provided within the propulsion turbine's superstructure. The interplanetary assembly includes the propulsion turbine's central driveshaft at its center. The central drive shaft rotates on main bearings held within the bearing housings joined to the center of each of the superstructure's two opposing stationary end disk assemblies. Fixed to each stationary opposing disk assembly arranged concentrically around the central drive shaft bearing housing and central axis is a ring shaped stationary sun gear.

The planetary turbine includes an outer frame structure joined concentrically to a shaft rotatable by bearing means about a through axle or split upper and lower axle serving as the planetary turbine's central axis, the outer frame structure including a pair of end assemblies extending parallel and spaced longitudinally apart along said planetary turbine's axis, axle and/or central shaft. Each planetary turbine also having an identically pair of matching opposing ring gears, of the identical size, pitch, angle, shape and inter-meshing characteristics as said ring shaped sun gear. Each planetary turbine's ring gear is joined concentrically to a central outer portion of its respective planetary turbine's end assembly. Each of the planetary turbine's ring gears are aligned and in a position corresponding to said sun gears, each planetary turbine ring gear is positioned on the same virtual plain as the opposed stationary sun gear that is joined to the inside central portion surrounding the central axis, and drive shaft bearing housing of each of the said superstructure's two opposing end disk assemblies.

The interplanetary hub assembly includes a pair of opposing hub structures. Each hub structure often having evenly spaced spoke like arms, each arms arm strengthen and reinforced with a cross braced members joined between each arm at its extremity reinforcing each hub structure into a cross braced assembly. Mounted on each hub structure's arm between the central hub portion of the arm hub structure and the structure's arm's extremity is joined a bearing and housing, with corresponding axle bearing that secures a rotatable interjacent reversing gear.

The reversing gear is aligned in between the sun gear and each planetary turbine's ring gear positioned on the same virtual plain, intermeshing with and between the adjacent stationary sun gear and its corresponding planetary turbine's outer ring gear, the rotatable interjacent reversing gear having identical pitch, tooth angle and intermeshing characteristics as the sun gear and planetary ring gear. This gear relationship with this gearing ratio is an important embodiment of the propulsion turbine's overall design, for with this gearing relationship the planetary turbine will rotate once around its main shaft and central axis as the driveshaft and joined interplanetary turbine assembly holding the planetary turbines counter-rotates once around the propulsion turbine's central axis. The net result of this gearing ratio keeps each rotating planetary turbine and its drive wings in a fixed position relative to the direction of created fluid current or the crafts trajectory and thrust.

Planetary Turbines

The invention introduces the use of a plurality of planetary turbines, each usually with two opposing wings mounted on pivot shafts. Each pivot shaft enables its respective wing to rotate cyclically from a current engaging orientation (drive position) in which the wing presents a flat surface approximately transverse to the direction of travel or created current in the drive side of the sweep vector, to a minimum drag feathered glide position of least resistance in the remaining approximately 180° glide vector with minimum energy loss until it returns into the drive vector and repeats the cycle and rotates the pivot shaft and moves into the drive position once again. Each wing is oriented so that the axis of the pivot shaft lies in the virtual plane that contains the wing.

The paired relationship of the pivot shafts of the opposing wings cause the wing of one shaft to be adjacent to the wing of the other shaft. Assuming the pivot shafts are in a horizontal position, the wing of the upper pivot shaft is disposed so that it rotates cyclically between extending upwardly vertically in the drive position to a neutral glide feather position in glide. The wing of the lower shaft is disposed so that it rotates cyclically between extending downwardly vertically in the drive position, to a neutral glide position. Thus the upper and lower shafts cyclically and repeatedly rotate their wing into the drive position, the former rotating upwardly and the latter rotating downwardly, so that the entire concentric drive vector is swept by the opposing wings having a combined frontal contact surface matching the cross section of the drive vector. Thus the wings are fully deployed to completely and repeatedly impinge on the fluid in their drive vector creating fluid current or thrust to do useful work.

The invention also provides a support structure for each pair of opposed pivoting wings. Each pivot shaft and wing assembly is supported in a journal on bearings attached to the support structure; the preferred embodiment provides two pivot shafts for a total of two pivot shafts and two wings. Each wing can be made of one panel or separated into multiple panels still arranged on the same virtual plane in a series with each panel and tubular pivot shaft independently rotatable about a common pivot axle. Each Pair of opposing wings or series of multiple pairs of opposing wings can be geared to one another to operate in tandem or to operate independent of the other pairs. With this arrangement each opposing wing becomes counter-balanced with the other.

Positioning the Pivot Shaft and Wing Assembly:

Each single or multi paneled opposed pair of wings is supported within the perimeter operating space of the planetary turbine's structure. Although wing position vary in different designs, it is always essential that the opposed wings pivoting orientation is transverse to the direction of travel, thrust or created current. In some designs this objective is achieved by supporting the opposed pivot shaft and pivoting wings vertically or horizontally from the center of the operating space within the planetary turbine structure. In other designs this objective can be achieved by having the opposed wings decentralized pivoting inward from the perimeter edges that define the interior operating space of the planetary turbines structure. The varying support placement of the pair of opposed wing and pivot shafts relative to the operating space within the planetary turbine, determines the various types of planetary turbine designs.

Each support surface within the planetary turbine is rotatable about a centralized axis by bearing means. The complete winged assembly attached to the support structure forms an orbiting planetary turbine as will be further described below. Each end of each pivot shaft is secured in a bushing or by bearing means within the frame structure, so that the pivot shaft portion where each wing is attached is supported at its end by bearing means within the perimeter of the planetary turbine's hub assembly.

Each support frame or end assembly can include a drive stop positioned to support and brace the wing in its drive position. Each drive stop is often defined by shallow side walls and having a shock absorbing material lining to be impinged upon by all or part of the periphery of the respective wing as the wing is urged to rotate into the drive position, and/or the wing instead can have opposing magnets placed along all or part of its perimeter to be repelled by the opposed magnet lining the drive stop/s. The drive stop are significant in that they receive the majority of the current or thrust force on the wing in the drive position, and transfer that force evenly to the planetary turbine's outer frame and throughout the propulsions turbine's entire rotating assemblies thus unloading many potential stresses from the pivot shafts and their attachment to their wings.

Drive Stop Accelerator:

A drive stop or pair of drive stops serving some portion of the perimeter of the wing instead of being attached to the frame structure in a fixed stationary position adjacent to the perimeter of the wing in its deployed drive position instead pivots, on the same radius as the wing supporting the wing at any angle of drive engagement. The drive stop frame structure that serves some portion of the perimeter of the wing is fixed to a pivot point adjacent to the juncture of the wing's pivot shaft and wing connection thereby pivoting on the same pivot radius as the wing. The activating arm attached to the drive stop frame limits the pitch of the wing's drive engagement thereby becoming an accelerator that increases or decreases the blade angle of attack into the drive quadrants to increase or decrease the production of fluid flow or thrust. The drive stop accelerator will be described in more detail below.

In some designs, in addition to serve as a support structure for the drive stop or drive- stop accelerator the planetary turbine support frame can be covered and also serve as a wing side fairing increasing fluid loading on the wings in drive. The support structures can have tear dropped shaped leading and trailing edges to reduce drag in glide. The side support structure can be lengthened with stabilizing fairing that serve to further increase wing loading of fluid current capture. The stabilizers also function to stabilize each rotating planetary turbine absorbing the impact of its trans-drive wings contacting their drive stops, working in concert with the other planetary turbines that are in their trans-glide, glide and drive cycle to help stabilize the entire interplanetary assembly. The thin profile are aerodynamically shaped and oriented forward and parallel to the direction of created fluid flow or the crafts trajectory, aerodynamically shaped to create the least drag resistance while inhibiting the lateral escape and maximizing wing loading in drive. Because the wing planetary turbine's side structure, side fairing and/or stabilizer is always in a fixed position facing the direction of created fluid flow or thrust equal and balanced pressure from forward movement is always exerted to each side of its narrow forward facing symmetrical tear dropped profile, creating little sideways drag in its lateral movement across the sweep vector. Wing side fairing and stabilizer fairings will be explained in more detail in the Detailed Description below.

In further development of the invention, a pair of propulsion turbines may be provided, one the mirror image of the other and arrange to rotate in opposite directions held within the same common superstructure. The twin turbine arrangement permits the torque of one turbine to be neutralized by the torque of the other so that there is a net zero torque exerted on their common housing. The pair may be disposed in adjacent side by side relationship whereby either the two drive sides or the two glide sides are adjacent creating symmetrically balanced discharge. Because one propulsion turbine mirrors it's twin the counter motions within both become dynamically counter-balanced within their common housing structure, with each having symmetric discharge current or thrust and trajectory dynamically balanced.

The counter rotating central drive shafts of the two propulsion turbines or fans in a side by side orientation may be mechanically connected to gears chains pulley or similar mechanism known in the art to be synchronized to perform useful work. In similar adaptation a pair of propulsion turbine's or fans may be connected end-to-end in axial alignment with the central drive shaft aligned and so connected to do useful work. The two turbines counter rotate so that the net torque on the assembly remains effectively zero.

When used as a pump or fan for fluid displacement the propulsion turbine can be placed on a rotatable platform that will rotate the housing and discharge opening thereby directing created current as desired.

The propulsion turbine when used as a craft may have ailerons, rudder or the like that will rotate the housing discharge openings thereby directing the discharge fluid currents or thrust and trajectory as desired. When used to propel a craft, steering and acceleration can also be achieved by trimming the wing angle of the wing's drive stops of one or the other propulsion turbine as above described and/or by increasing or diminishing the rotational RPM of either turbine.

Because of the frontal contact of the wings engage a high fraction of the surface discharge area, it is believed that as a propulsion devise this machine by virtue of this efficient use of surface area, will retain traction in thin atmospheres better than propeller devices.

Although the Propulsion turbine above described uses mechanical gears as the means of power transmission these designs can alternatively incorporate electro-magnetic suspension and electro dynamic suspension Maglev technology to rotate and power the turbine with computerized regulators keeping the crucial one to one counter rotating ratio between assembly A101 and A102 around their respective axis. Although the invention is described above with reference to the creation of air current or thrust it may be appreciated that this propulsion turbine or fan can operated as a propulsion device or pump in any fluid environment and may be ideally used to propel a ship.

DESCRIPTION OF THE DRAWINGS

FIG. 2E—A perspective detail of the four types of planetary turbines.

FIG. 2F—A perspective view of A102 showing the placement of gears 3, 2, and 6.

DETAILED DESCRIPTION OF THE INVENTION

With regard to FIGS. 1 and 2, the propulsion turbine includes an outer framed super structure A103 joined concentrically to the drive shaft housing 8 and central sun gear 6. The outer frame super structure includes a pair of end disk assemblies 103 extending parallel and spaced apart along the central axis of said central driveshaft housing and sun gear creating a defined interior space for the operation of a plurality of orbiting planetary turbines within.

Figure 1A:
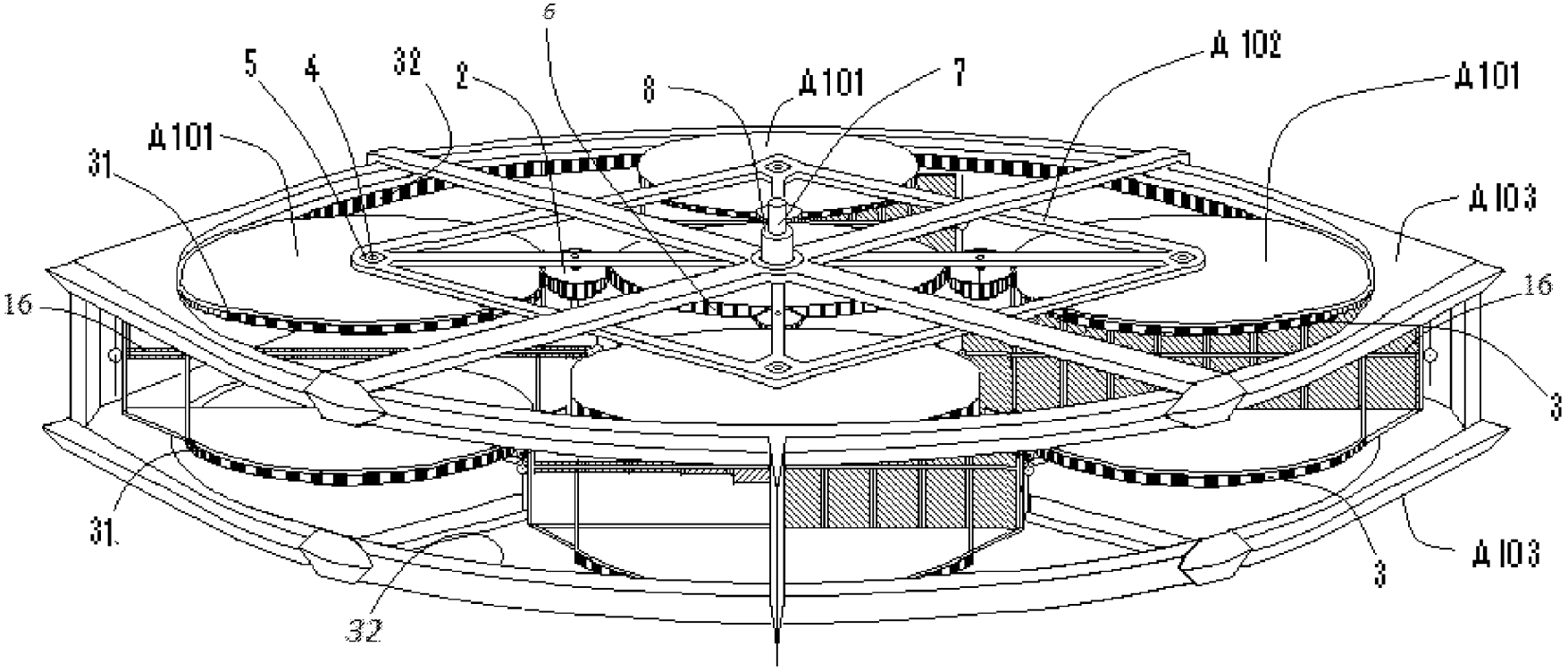
FIG. 1A—Perspective view of the propulsion turbine A100 type one.
Figure 1B:
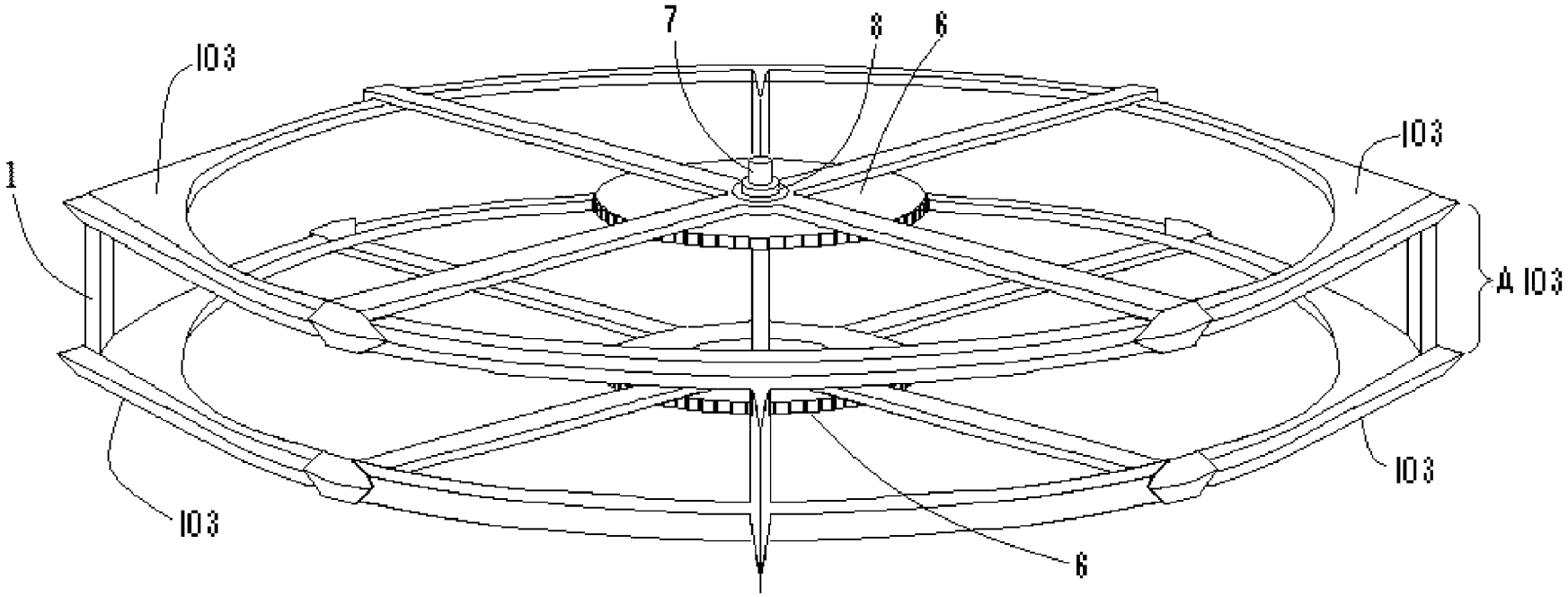
FIG. 1B—Perspective view of the stationary superstructure A103, sun gear and bearing housing 8.
Figure 2A:
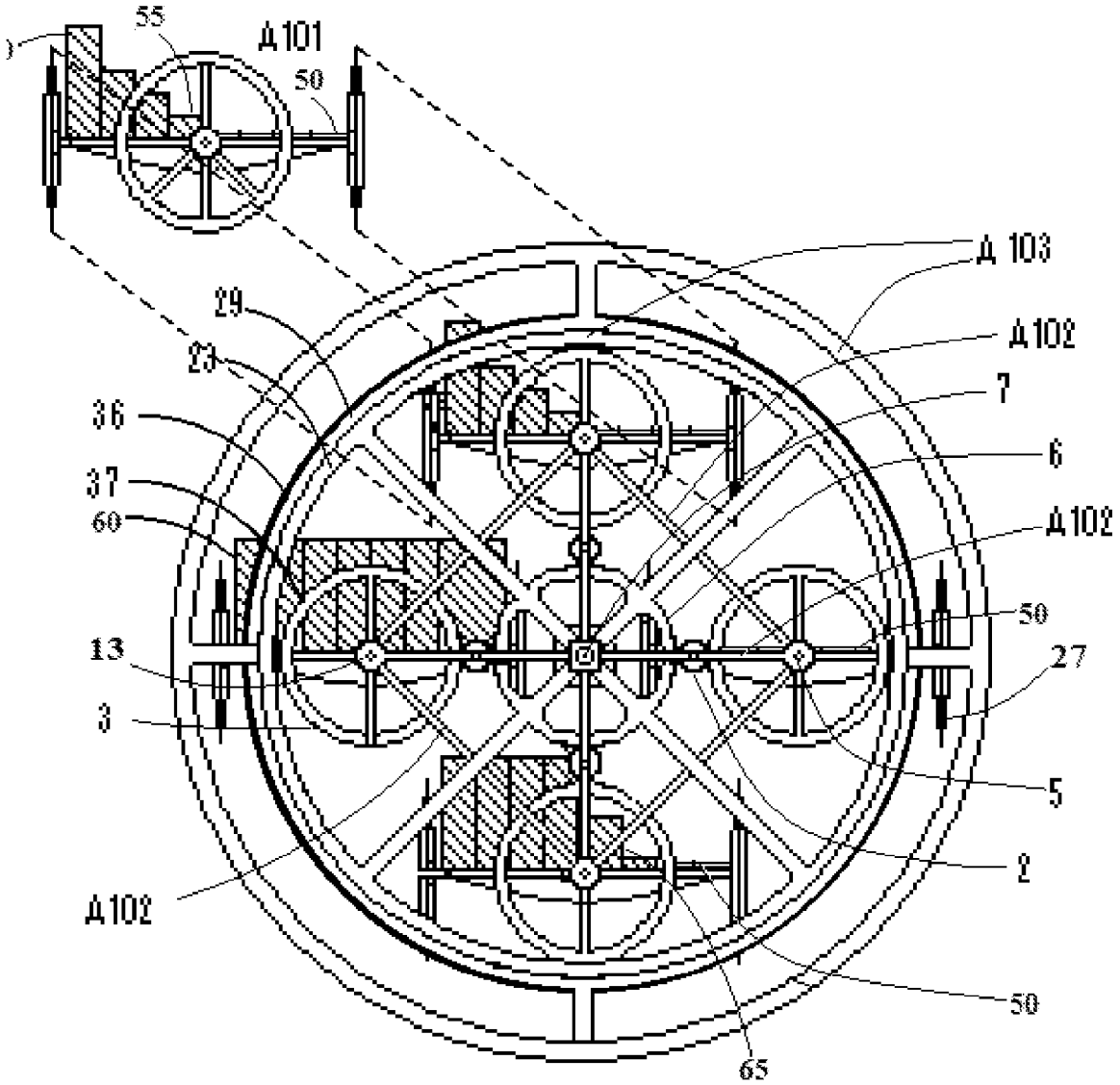
FIG. 2A—Top view of an example of an A100 propulsion turbine with pullout of A101.

An example of a planetary turbine A101 is exclusively featured in FIG. 3A. The propulsion Turbine houses two or more rotating planetary turbine assemblies A101 within the inner circumference provided within superstructure A103 as shown in FIG. 1A and A103 is exclusively featured in FIG. 1B. Each rotatable planetary turbine assembly A101 is held by the interplanetary hub assembly A102. An example of this arrangement is seen in FIG. 2D. with two of the four turbines in this example installed.

Figure 2B:
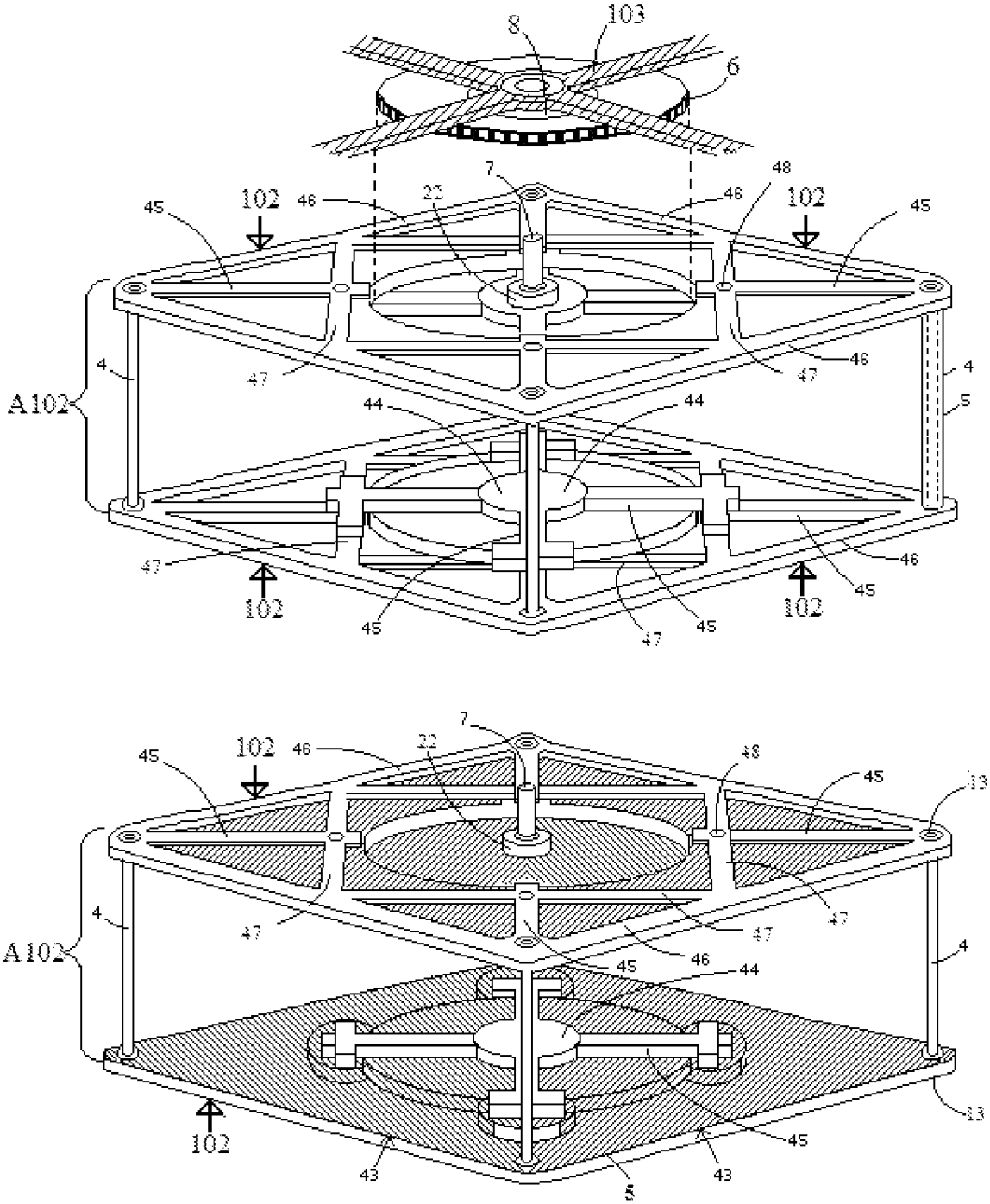
FIG. 2B—Upper image is a detail of an interplanetary hub assembly A102 without cover 43. Lower image is interplanetary hub assembly with cover 43.
Figure 2C:
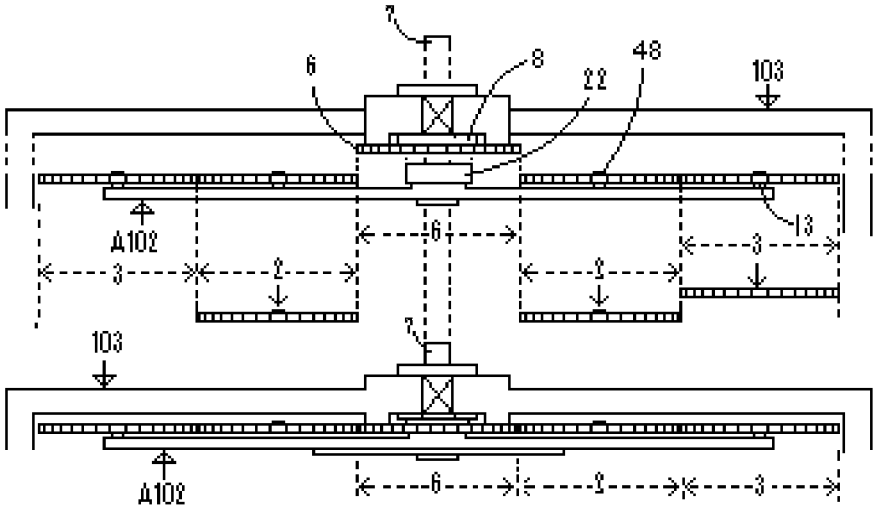
FIG. 2C—Side view of A103 and A102 drive gears; sun gear 6, reversing gear 2, and planetary gear 3.
Figure 2D:
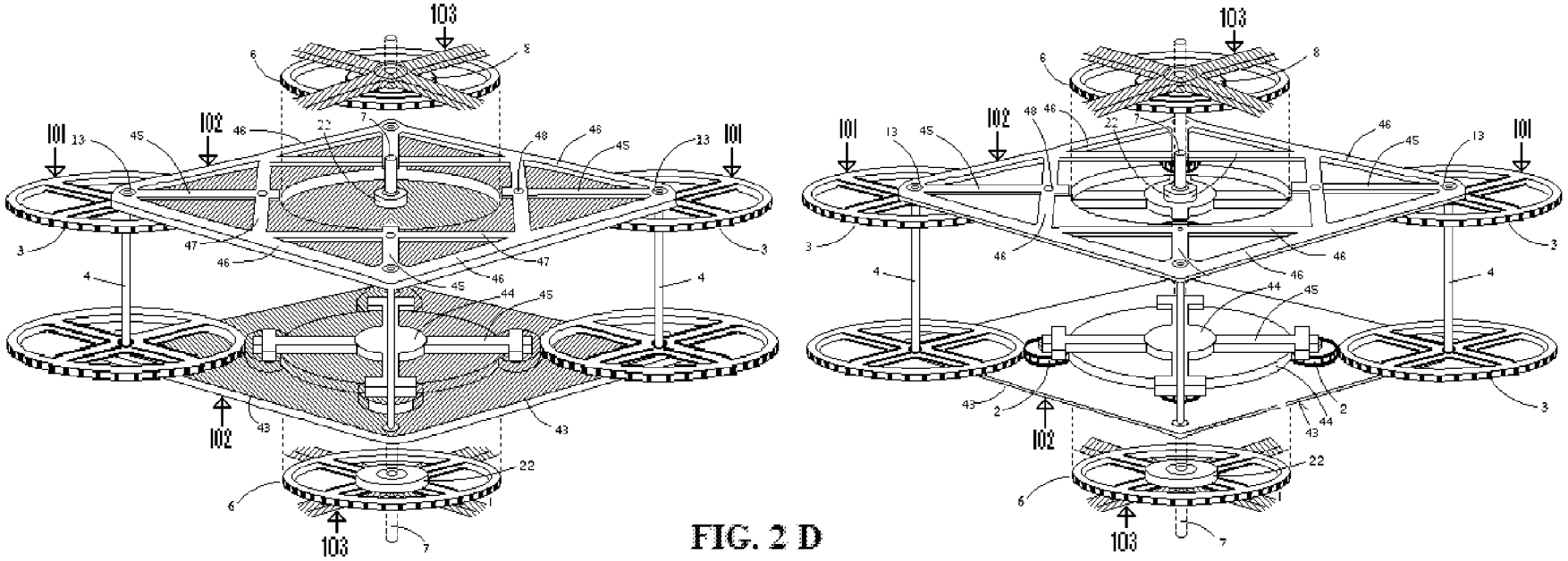
FIG. 2D—Image on the left is perspective view of A102 with cover 43 and two A101's each with opposed gear 3 installed. Image at the right is the same as left image without cover 43 with two A101's with opposed gear 3 and gears 2 installed, with sun gear 6 and joined A103 pulled up out of alignment for visualization purposes.
Figure 2E:
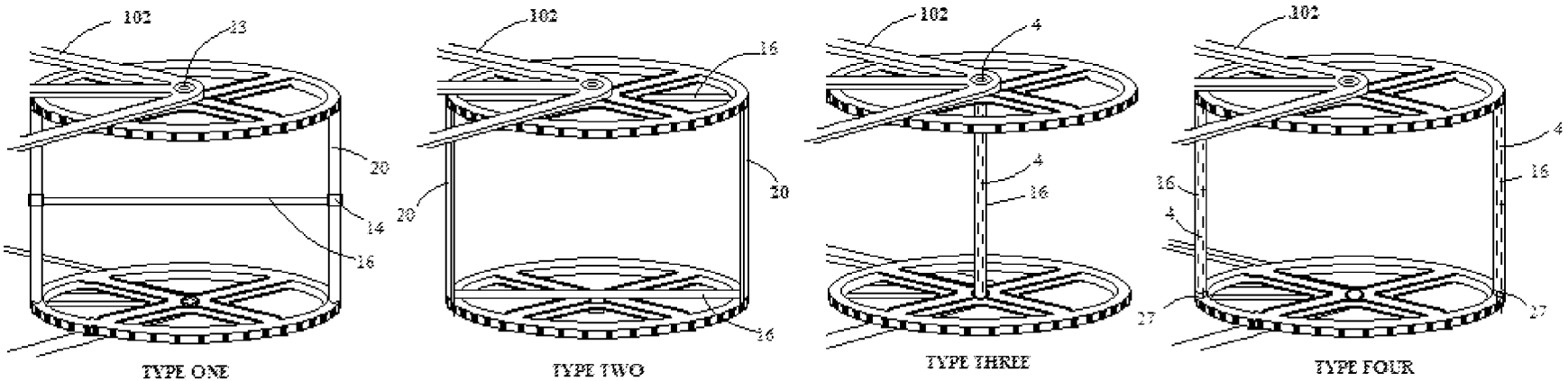
Figure 2F:
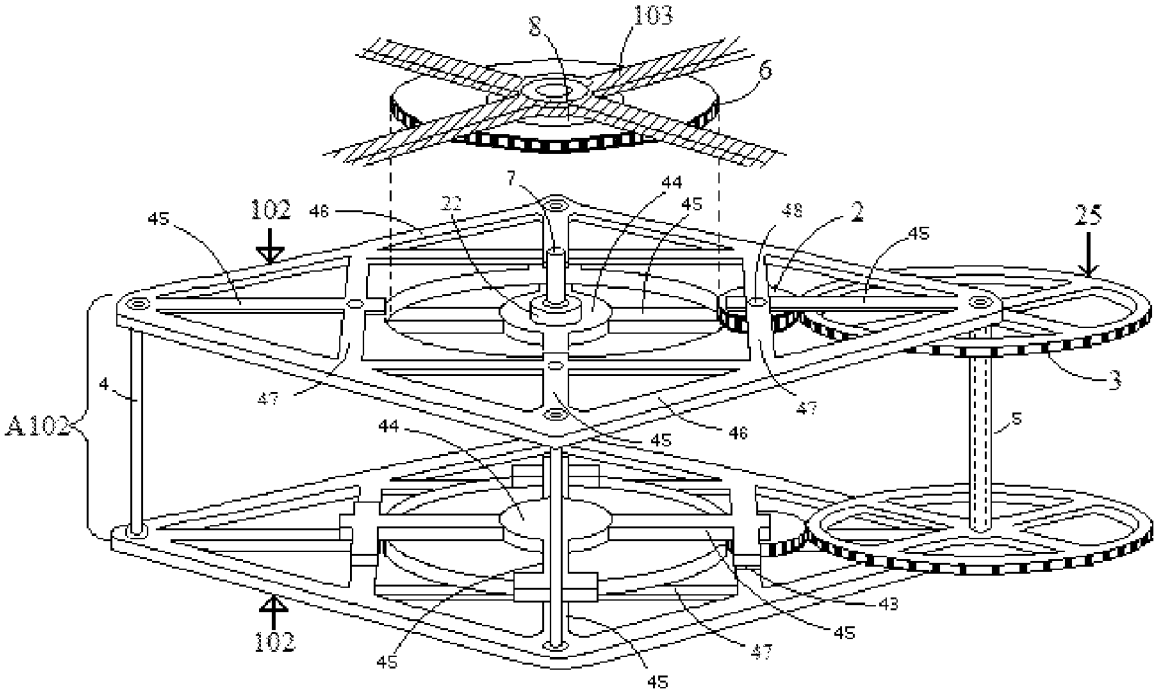

FIG. 2B has two images. The upper image shows the interplanetary hub assembly A102 with a part of the inter-stationary end disk ass. 103, and joined sun gear 6 pulled up out of place for visualization purposes. The lower image shows A102 in isolation with cover 43. In FIG. 2F the interplanetary hub assembly is seen with a planetary turbine's reversing gear 2, ring gear 3 and end assembly 25 installed showing their relationship with the inter-stationary sun gear 6 and the interplanetary hub assembly A102 at the right side of the image. The lower image shows the interplanetary hub assembly A102 in isolation with its inner cover plates 43. In operation A102 can have outer cover plates 43 as well.

Each planetary turbine assembly A101 is made to counter rotate once around its axis (axle 4), as the central drive shaft 7 joined to the interplanetary hub assembly A102 that holds the planetary turbines, counter rotates in the opposite direction once around the propulsion turbines central sun gear and axis thereby maintaining the wings of the planetary turbines crucial broadside 90 degree orientation to the direction of current creation or forward movement. The counter rotating assemblies A101 and A102 will be each explained in detail below.

In the example seen in FIG. 1 the turbine A100 is moving toward the viewer and its current discharge is exiting out the back away from the viewer. The crosshatched wings on the right side of FIG. 1 are in drive turning counterclockwise sucking the incident fluid in its environment into the intake facing the viewer and expelling the discharged fluid out its exhaust out the back side of the turbine away from the viewer. In FIG. 2A, being a top view, the cross hatched wings are in glide on the left side of the Figure rotating counter clockwise.

The present invention generally comprises a propulsion turbine that when powered by a man made power source is designed to maximize the frontal contact surface area and resulting created fluid current displacement in its ambient fluid environment. The propulsion turbine can be used to propel a craft through water or space or as a fan to propel the displacement of fluid in its environment. The propulsion turbine is constructed as a modular assembly having a central axis about which its central drive shaft rotates. The propulsion turbine, henceforth can also be referred to as A 100, as seen in FIG. 1A and FIG. 2A is comprised of a plurality of planetary turbines henceforth referred to as A101 that orbit around central axis within the confines of the machines superstructure A103 seen in FIG. 1B.

Models and Class Designations

The propulsion turbine is comprised of an outer frame superstructure housing a rotating central driveshaft that is joined to an interplanetary assembly that secures, in an evenly spaced manner, a plurality of orbiting planetary turbines, each independently rotating within the superstructure, with pivoting opposed wings that open to a position of maximum fluid displacement when fully deploy in drive and close to a position of least drag resistance, when retracted in glide. The orientation of the planetary turbine's wing's pivot axis within the interior operating space provided by planetary turbine relative to the propulsion turbine's central driveshaft defines the type of a planetary turbine.

In this document four such planetary turbines (A101) types are featured. An example of each of the four A101 types is seen in FIG. 2E. Presuming that the central axis and drive shaft of the propulsion turbine A100 is in a vertical position the example are as follows:

Type one—A101 (Assembly 101): In type one the wing's pivot axis is centrally placed within the perimeter defining the operating space within the planetary turbine with said pivot axis perpendicular to the propulsion turbine's central axis and drive shaft. An example of this type one configuration is seen in FIG. 2E and FIG. 1A.

Figure 21:
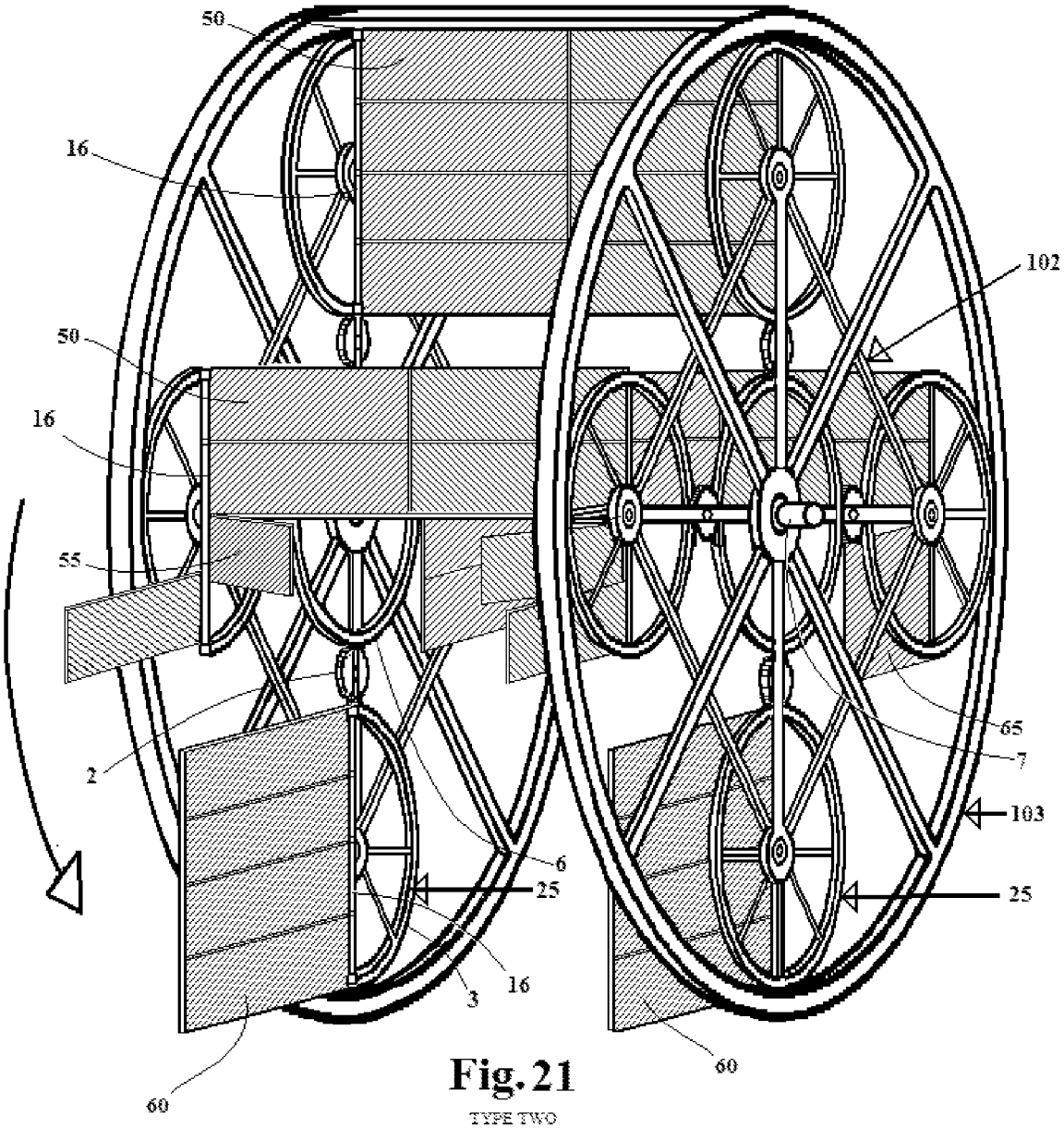
Figure 22:
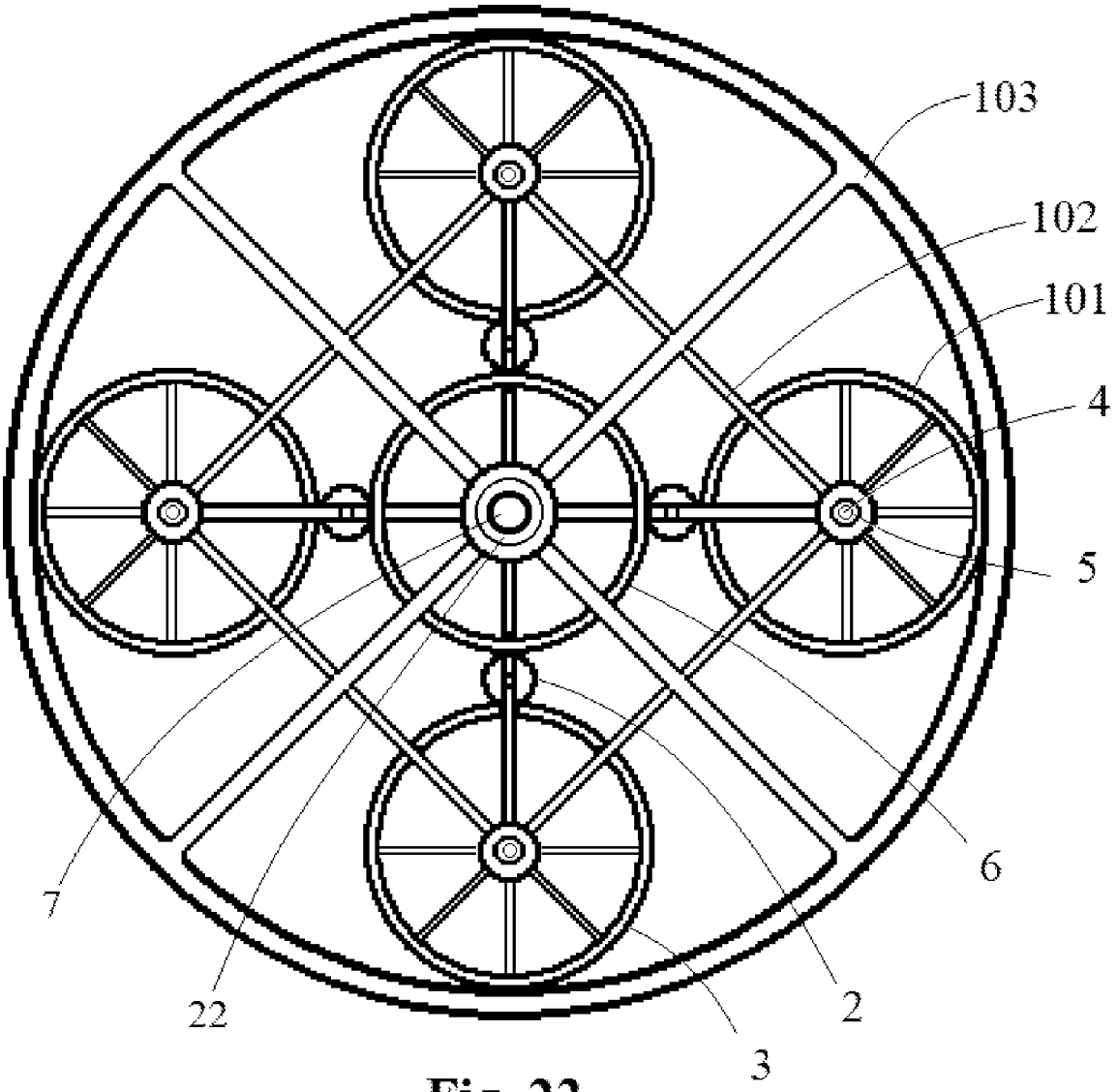
FIG. 22—Is a side view of FIGS. 21, 23 and 23 parts 103, 102 and gears 2,3, and 6.

Type two—A101: In type two each wing's pivot axis is decentralized, placed on opposing surfaces within the perimeter defining the operating space within the planetary turbine with said pivot axis perpendicular to the propulsion turbine's central drive shaft. An example of this configuration is seen in FIG. 2E and FIG. 21.

Figure 24:
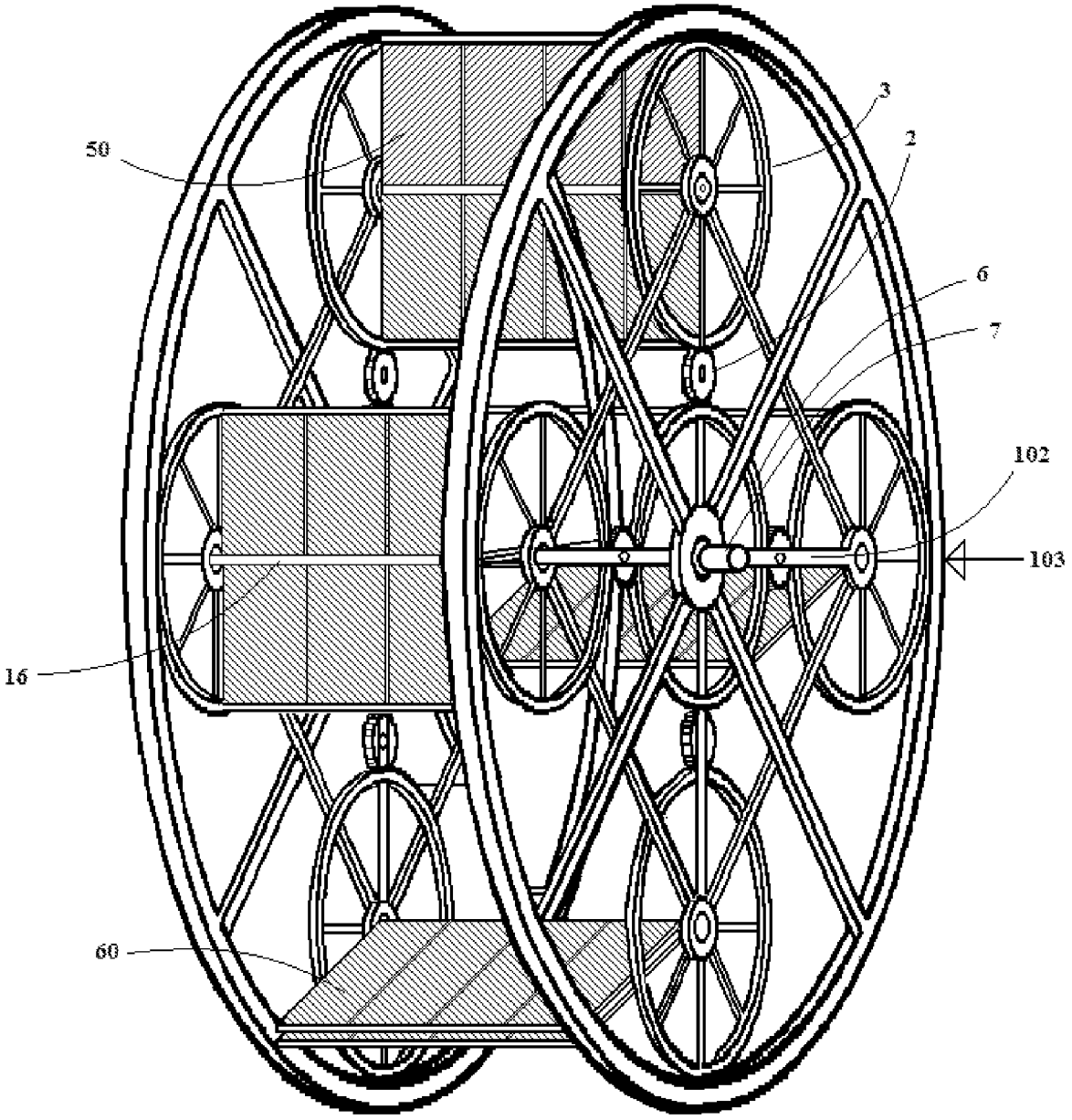
FIG. 24—Perspective view of a type "three" A100 propulsion turbine.

Type three—A101: In type three the wing's pivot axis is centralized within the perimeter defining the operating space of within the planetary turbine with said pivot axis parallel to the propulsion turbine's central drive shaft as seen in FIG. 24 and FIG. 2E.

Figure 23:
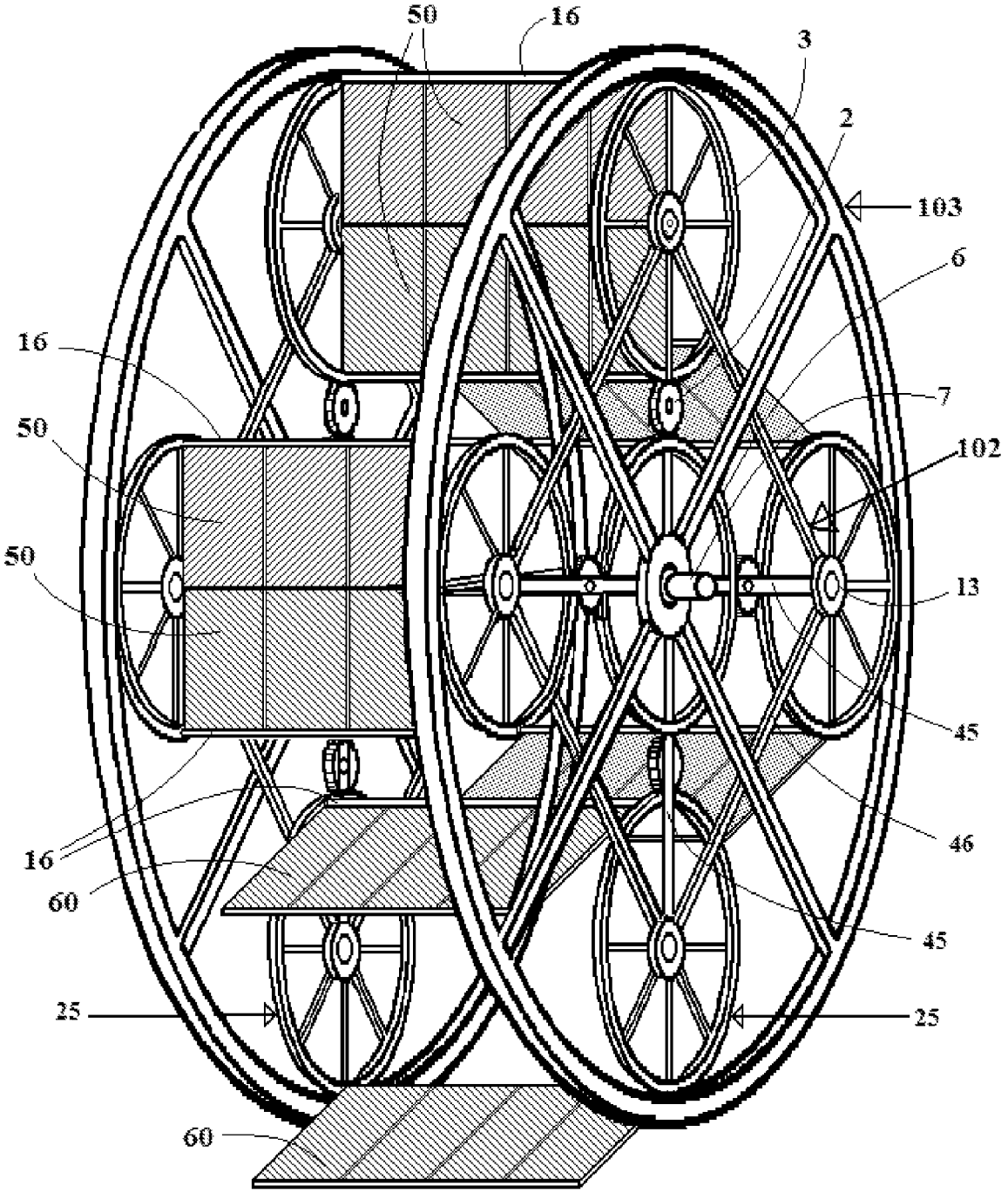
FIG. 23—Perspective view of type "four" A100 propulsion turbine.

Type four—A101: In type four the wing's pivot axis is decentralized placed on opposing surfaces within the perimeter defining the operating space within the planetary turbine, with said pivot axis parallel to the propulsion turbine's central drive shaft. An example is seen in FIG. 2E and FIG. 23. Note some pivot shafts extend out of the operating space within the planetary turbine There are also two classes of propulsion turbines featured as design examples in this document. The relationship of the wing's concentric sweep vector relative to the direction of created current or crafts trajectory determines the class of the propulsion turbines that determines, wing design, landing gear, and other vertical or horizontally oriented equipment.

Class "A" propulsion turbines: The class "A" propulsion turbine's have planetary turbines having their wing's sweep vector perpendicular to the created current or the craft's trajectory. An example of a turbine so configured (when A102's rotational orientation is horizontal to the earth) is seen in FIG. 1A and FIG. 2A. with multi-paneled wings.

Class "B" propulsion turbines: Class "B" propulsion turbines have planetary turbines having their wing's sweep vector parallel to the created current or the crafts trajectory. An example of a turbine so configured (when A102 is vertical to the earth) is seen in FIG. 24.

The propulsion turbine includes a pair of opposed outer framed end disk structures 103 joined concentrically to the drive shaft bearing housing 8 and central sun gear 6 with each end disk structure joined by side structure 1 forming superstructure A103 (assembly 103). Super structure A103 is seen in FIG. 1B. The outer frame super structure includes a pair of end disk assemblies each with drive shaft bearing housing 8 and centralized sun gear 6 extending parallel and spaced apart along the propulsion turbine's central axis creating a defined interior space for the operation of the orbiting planetary turbines within. Said end disc assemblies will henceforth also be referred part 103 and the complete inter stationary superstructure assembly that includes without limitation each end disk assembly corresponding joined central drive shaft bearing housing 8, joined sun gear and side support structures will henceforth be referred to as A103 (assembly 103) as seen in FIG. 1B.

The wings of each A100's planetary turbines, although rotating on its axis, always stay in a fixed position facing transverse, crosswise to the direction of created current and/or forward movement. The natural consequence of this design allows the wing's drive stop assembly 26, seen in FIG. 3, to always be behind the wing in drive, bracing it in approx. 180 degree rotational drive cycle and always in front of its wing in the approx 180 degree glide cycle allowing the opposing closing wing tips to collapse close to their reduced glide profile of least resistance in glide as illustrated in FIG. 1A and FIG. 2A.

The wings of the propulsion turbine create current or thrust by pushing against the ambient air or water surrounding it. Thus the propulsion turbine as a propeller is useful for creating current as a fan or creating thrust that can propel it and its attachment in the opposite direction, through space in much in the same manner as the engaged paddles of a canoe propel a canoe and its rider through the water. The craft may increase its forward movement until the power source driving it can no longer exceed its created thrust or the material integrity of the craft can no longer exceed the resistance of it ambient atmosphere or environment. Attached at the center of each of the super structure's two disk assemblies 103 is a stationary central drive shaft bearing housing 8 that holds, central drive shaft bearing 22 that serves as the rotation bearing for the central drive shaft 7 that is joined to the interplanetary hub assembly A102 that rotates about the propulsion turbine's central axis between the super structure's A103 two end disc assemblies 103.

In one design possibility seen in the example in FIG. 2D, each opposing interplanetary hub structure 102 has spoke-like arms 45 that radiate out from a disc shaped hub 44 that surrounds and is joined to the central drive shaft 7. Assuming that the central axis of A100 is vertical, each extending hub arm 45 radiates out of each disc shaped hub 44 of each opposed hub structure 102 on the same horizontal plain, each arm arranged concentrically at evenly spaced intervals around the circumference containing each hub structure 102, as seen in FIG. 2D. The arms 45 of each opposing hub structure have a plurality of perimeter braces 46 and cross-braces 47 as seen in FIG. 2B and FIG. 2D. All hub arms 45 have a perimeter brace 46 that extends around the perimeter of each opposed hub structure 102 from the extremity of each arm. Between each perimeter brace 46 is an additional diagonal cross brace 47 extending midway between each perimeter brace 46 through the mid section of each hub arm 45.

In FIG. 2B there are two images. The upper image is a A102 show the interplanetary hub structure A102 without covers 43, the lower image below shows A102 with one of its covers installed. At the extension of each opposing pair of arms 45 of each opposed hub structure 102 is a bearing and bearing housing 13 in mutual vertical alignment with the opposing bearing and bearing housing 13 in the other corresponding opposed arm of the opposed hub structure 102, the center of this aligned bearing relationship thereby defining the central axis of the respective planetary turbine about which a planetary turbine A101 will rotate.

Between each pair of the hub's opposing arms is secured, by bearing means, a rotatable planetary turbine A101, each A101 concentrically arranged and held apart from one another, by each pair of opposed arms 45 in bearing and bearing housing 13 of the interplanetary hub assembly A102, the interplanetary hub assembly holding each rotating planetary turbine in an evenly spaced manner, allowing each planetary turbine to rotate independent of the other, in its own operating space provided within the propulsion turbine's superstructure A103.

The top view of an A100 in FIG. 2A shows a planetary turbine A101 that is shown in a moved out position designated by broken lines at the upper left of the Figure. In the rest of the Figure is shown the interplanetary hub assembly holding each rotating planetary turbine in an evenly spaced manner. In FIG. 2B is shown the interplanetary assembly A102 with its opposed hub assemblies 102 held apart in this model by each planetary turbine's inter-stationary axle 4. At the right of the upper Figure axle 4 is identified with broken lines inside of planetary turbine's main shaft 5.

It should be noted that throughout this document often the upper and lower end disk structures 103, the upper and lower hub structure 102 and the upper and lower planetary turbine end assemblies 25 are shown without covers to expose their internal structure for viewing purposes. In operation these assemblies may have any portion of their surfaces covered to aerodynamically enhance their performance structural integrity and/or efficiency.

The interplanetary hub assembly A102 includes the propulsion turbine's central driveshaft 7 at its center. The central drive shaft rotates on main bearings 22 held within the main bearing housings 8 that is joined to the center of each of the superstructure's two opposing stationary end disk assemblies 103. Also joined to each stationary opposing side of each disk assembly 103 arranged concentrically around joined bearing housing 8 and the central axis is a ring shaped stationary sun gear 6 as seen in side view FIG. 2C and at the top of perspective view FIG. 1B. In regard to FIG. 2C the upper image shows an end disk assembly 103 with joined sun gear 6 pull up away from gear 2 and 3 attached to the interplanetary turbine assembly 102 for viewing purposes. The lower image shows the two assemblies 102 and 103 in their operating position will both sets of gears 2, 3, and 6 all intermeshing on the same virtual plane.

Each opposing hub structure 102 of the interplanetary hub assembly A102 additionally is joined with a cross braced structure with one member of that structure braces 46 extending between the extremity of each two extended hub arms 45 reinforcing and further unifying the fixed position of each arm's extremity and its respective planetary turbine bearing and bearing housings 13. Each hub structure 102 extend parallel and are spaced apart along the central axis of A 103. Hub structure 102 are often joined by axle 4 as seen in FIG. 2D unifying all arms of each hub structure 102 into one unified cross braced inter planetary turbine assembly A 102 as seen in FIG. 2B.

On each hub structure's 102 arm 45, in between the hub portion of the arm and the arm's extremity and adjacent to cross brace 47 is joined a bearing housing with bearing and axle 48, around which rotates an interjacent reversing gear 2. An interjacent reversing gear 2 is align in between the sun gear 6 and each planetary turbine's ring gear 3 positioned to intermesh on the same virtual plane, having identical pitch, tooth angle and intermeshing characteristics as the stationary sun gear 6 and planetary turbine's rotating outer ring gear 3. An example of these three intermeshing gears and hub assembly A102 and their relationship with one another is seen in FIG. 2E Each pair of each ring gear 3 and 6 are all positioned and aligned on the same virtual plane. Between each ring gear 3 and sun gear 6 is a rotatable interjacent reversing gear 2 also in alignment and on the same virtual plane intermeshing with the planetary ring gear. 3 and the inter-stationary sun gear 6.

This gear relationship with the one to one counter rotating gearing ratio is an important embodiment of the propulsion turbine's overall design, for with this gear-train each planetary turbine main shaft 5 will rotate once around its axle 4 and central axis as the interplanetary turbine assembly holding the planetary turbines and joined central drive shaft 7 counter-rotates within the propulsion turbine's superstructure A103, and central main bearing housing 8 and around sun gear 6 and the propulsion turbine's central axis. The net result of this one to one counter rotating gearing ratio keeps each rotating planetary turbine's wings and components in a fixed transverse position relative to the direction of created fluid current or thrust.

Planetary Turbine

The Planetary turbine A101 is similar to A103 in shape, both are individually coaxially constructed structures but A101 is much smaller, comprised of two end assemblies 101. Propulsion turbines can include 2 or more orbiting planetary turbines. The propulsion turbine in FIG. 1A and top view 2A has four planetary turbines.

There are 4 types of planetary turbines as stated above, the orientation of the wing's pivot axis within its planetary turbine relative to the propulsion turbine's central driveshaft defines the type of a planetary turbine. Each planetary turbine A101 includes a frame structure joined concentrically to a central main shaft 5 as seen in FIG. 1A and exclusively in FIG. 3 with bearings and bearing housing 13 and optional axle 4 about which it rotates around its central axis.

Figure 3:
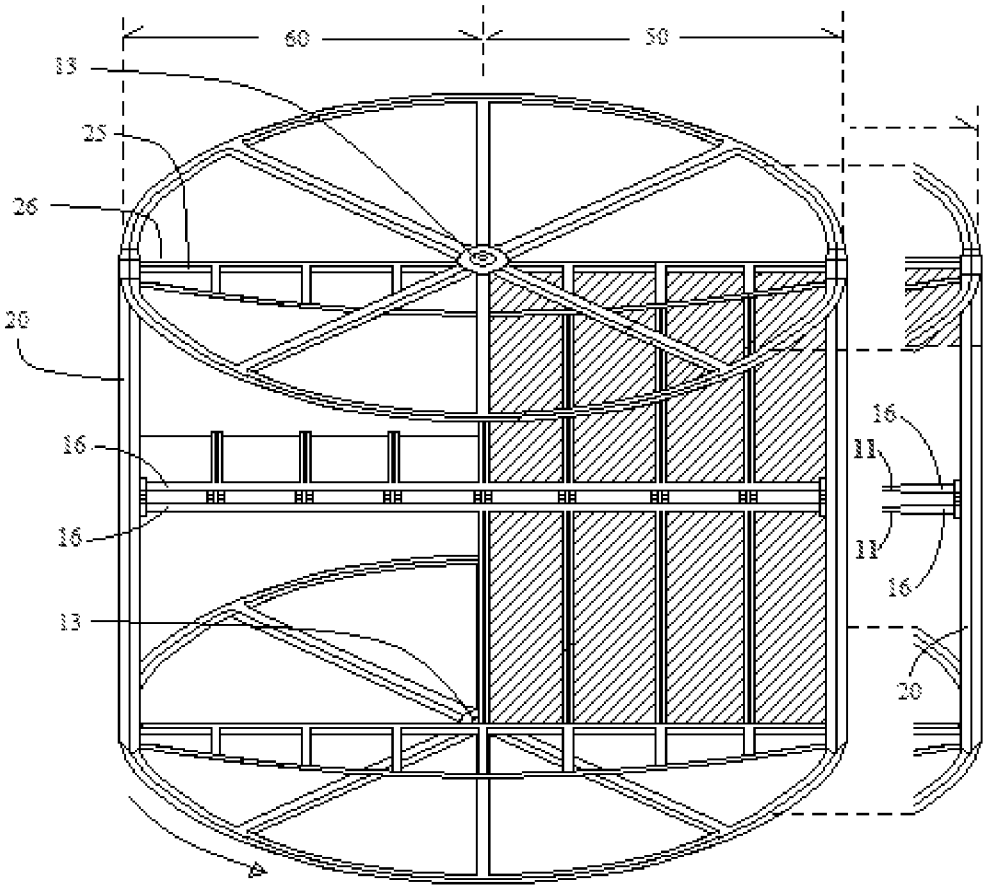
FIG. 3—Detail of a type 1 planetary turbine A101 with duplicated cut away of pivot axle 11 and side structure 20.

Presuming the central axis is vertical the four types of planetary turbines A101 are described below. In type one the planetary turbine's opposed end assemblies 101 are parallel and spaced apart along the planetary turbine's vertical central axis, each end assembly centrally held by an upper or lower axle and a corresponding upper and lower shaft (split main shaft 5) bearing and bearing housing. Each opposed end assembly held apart at its perimeter by opposing side support structures 20, with wings pivot shaft and/or pivot axles extending from one support structure 20 to the other, centered between the end assemblies in a position transverse to the direction of created current or thrust in drive. An example of a type one planetary turbine is seen in FIG. 2E and in FIG. 3. In FIG. 3 the planetary turbine is in between glide and drive with the wing to the right deployed in drive 50 and the wings on the left retracted in glide 60. The tear-dropped nose assembly A108 is not seen from this back side view of the A101.

Type two planetary turbines are configured as type one, except each wing's opposed pivot shaft 16 is attached to the upper or lower end assembly 101 with upper pivot shaft serving wings that pivot down vertically from their end assemblies and lower pivot shaft serving opposed wing that pivot up vertically from their corresponding lower end assembly 101 to a position transverse to the created current or thrust when deployed drive. Examples of A 100 type two planetary turbine is seen in FIG. 2E and installed in an A100 propulsion turbine in FIG. 21.

In type three as seen in FIG. 2E the upper and lower end assemblies are connected by the central axle 4 that run vertical down the central axis of the planetary turbine. The compound tubular pivot shaft 16 serves opposed wings that pivot horizontally to a position transverse to the created current or thrust when deployed drive. Type three planetary turbines pivot axis is parallel to the A100's central axis, an example is seen in FIGS. 24 and 2D.

In type four planetary turbines the turbine is configured like type one except each wing's pivot shaft 16 is supported on its corresponding axle 4 that also functions as A101 side support 20 or the pivot shaft is attached to stationary axle 4 adjacent side support 20 pivoting horizontally inward toward the planetary turbine's central axis to a position transverse to the created current or thrust when deployed in drive. Examples of A 100 with type four planetary turbines with pivot axis decentralized and parallel to A100's central axis can be seen in FIG. 23. Joined on the perimeter rim of one or both end assembly 101 of each planetary turbine is a ring gear 3 that is of identical size shape, gear angle pitch and intermeshing characteristics as the inter-stationary sun gear 6. The ring gears joined to their respective end assembly rotates with A101 around A101's central axis.

Planetary Turbine Pivoting Wings

Within each planetary turbine structure is held one or more pivoting wings and pivot shaft assembly that operates within each planetary turbines assemblies defined operating space, that pivot in the drive cycle to a position that is transverse to the created current or thrust. The purpose of the pivoting wing is to present a maximum contact surface profile in its 180 degree drive rotation and assume a minimum surface area, drag profile and resistance in the 180° of glide rotation. The axis of the pivot shaft and joined 90 degree pivoting wing or pair of opposed wings within the confines of each planetary turbines can be fixed to any diametric surface within the planetary turbine interior perimeter where said wing or said opposed pair of wings extend transverse to the created fluid current or direction of thrust to maximally impinge on said fluid current as illustrated above in the four type of planetary turbines.

Each planetary turbine can have a set of counterbalanced opposing wings, geared to one another, with wing gears 21, opening in the drive side of its sweep area to displace air or water in its environment and then close to a glide position of least resistance by the incident atmosphere or the oncoming current on the final glide half of its rotational cyclical excursion to again return into the drive quadrants to repeat the cycle. As a result air or water is displaced creating either current and/or thrust to do useful work.

There are a variety of pivoting wing assemblies A104, A105, A106, and A 107. The difference in these assemblies will be described below. Each planetary turbine A101 go through four cycles, drive 50, trans-glide 55, glide 60 and trans-drive 65 every revolution they and their corresponding planetary turbine rotate around their corresponding central axis. In many of the Figures these wing positions are so described.

The invention introduces the use of a plurality of planetary turbines, each usually equipped with two opposing wings mounted on pivot shafts. Each pivot shaft enables its respective wing to rotate cyclically from a maximum current displacing drive position numerically designate as 50 in which the wing presents a opposed surface approximately transverse to the direction of travel or created current in the drive side of the sweep vector, transitioning into trans-glide numerically designated as 55 to a sleek drag profile of minimum drag resistance of glide numerically designated as 60 thereby rotating with minimum energy loss until returning to trans-drive numerically designated as 65 completing the rotation and moving into drive 50 once again to repeat the four cycles. Each wing is oriented so that the axis of the pivot shaft lies in the virtual plane that contains the wing.

Assuming the pivot shafts 16 are in a horizontal position, the wing of the upper pivot shaft are disposed so that it rotates cyclically between extending upwardly vertically in the drive position to extend to a neutral glide feather position in glide. The wing of the lower shaft is disposed so that it rotates cyclically between extending downwardly vertically in the drive position, to a neutral glide position. Thus the upper and lower shafts cyclically and repeatedly rotate their wing into the drive position, the former rotating upwardly and the latter rotating downwardly, so that the entire concentric drive vector is swept by the transverse positioned wing rotating through the drive quadrants. Thus the wings are fully deployed to completely and repeatedly impinge on the fluid in its ambient environment creating fluid current or thrust to do useful work.

The top view of FIG. 2A shows the glide and drive cycles of the four planetary turbines A101 in the propulsion turbine assembly A100. A101 is seen in isolation at the upper left of the Figure. Half of the wings on the left side are in glide and the other half on the right are about to enter trans-glide from drive, the outer wing panel at the far left has pivoted to its glide position 60. The hinged wings are made of multiple panels. FIG. 2A is a top view of an A100. The wings of A100 at the left are in glide (crosshatched wings at the left of the Figure) as the wings transitions into the drive side of the sweep area shown at right side and drive side of the Figure the top of the two vertical wing panels are fully extended in drive 50, and so from this top perspective, are nearly out of view. These drive wings have been numerically designated as 50 seen at the bottom right side of the Figure. The other two wings belonging to the leading half of this A101 series of wing panels are in trans-drive 65. As the wing inter into the left side of the Figure the crosshatched wings are seen transitioning into glide, from this perspective, reappearing to their full glide horizontal posture.

Styles of Wings and Pivot Shafts

Figure 4A:
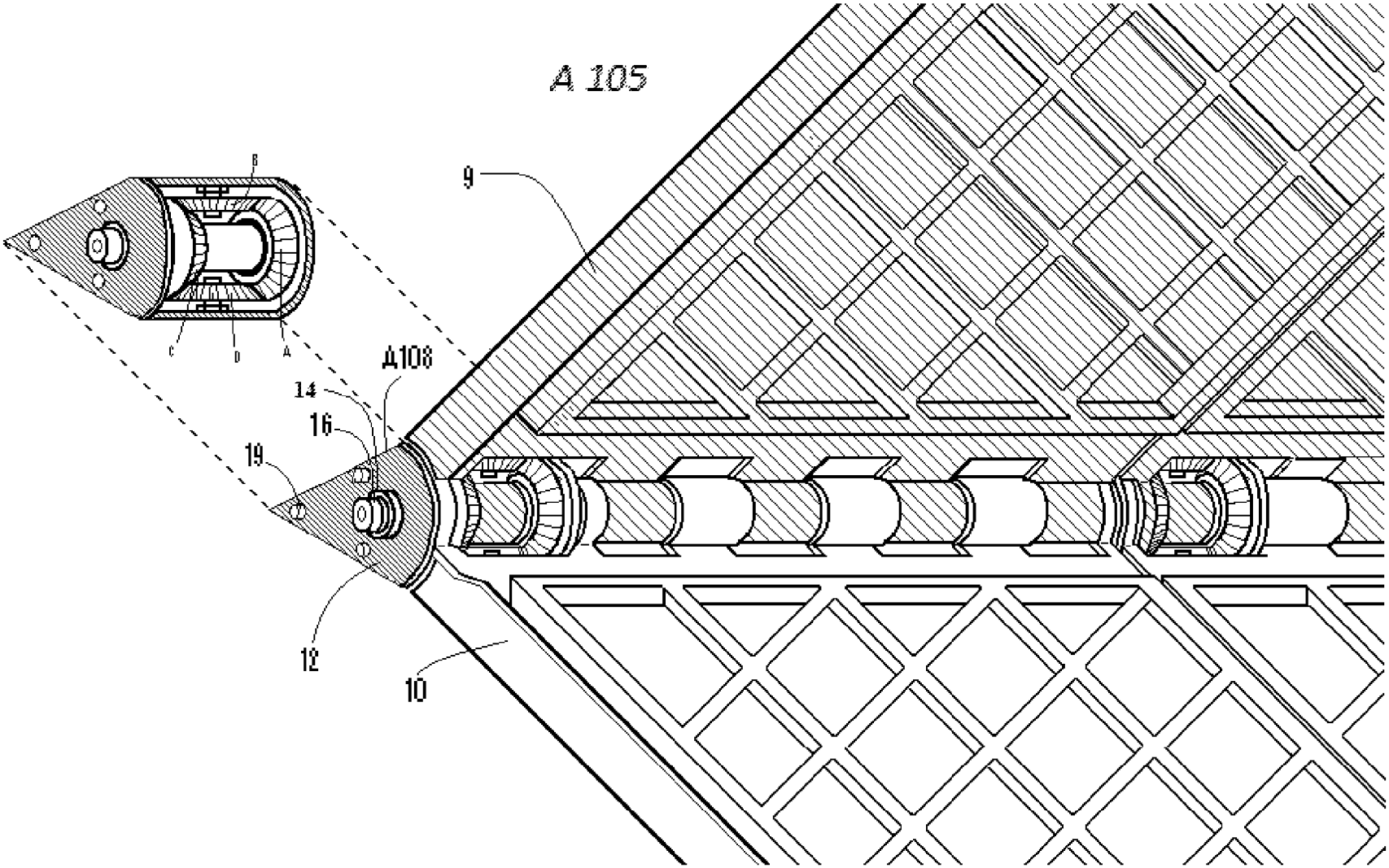
FIG. 4A—Detail perspective view of a consolidated pivot shaft and wing ass. A105.
Figure 5:
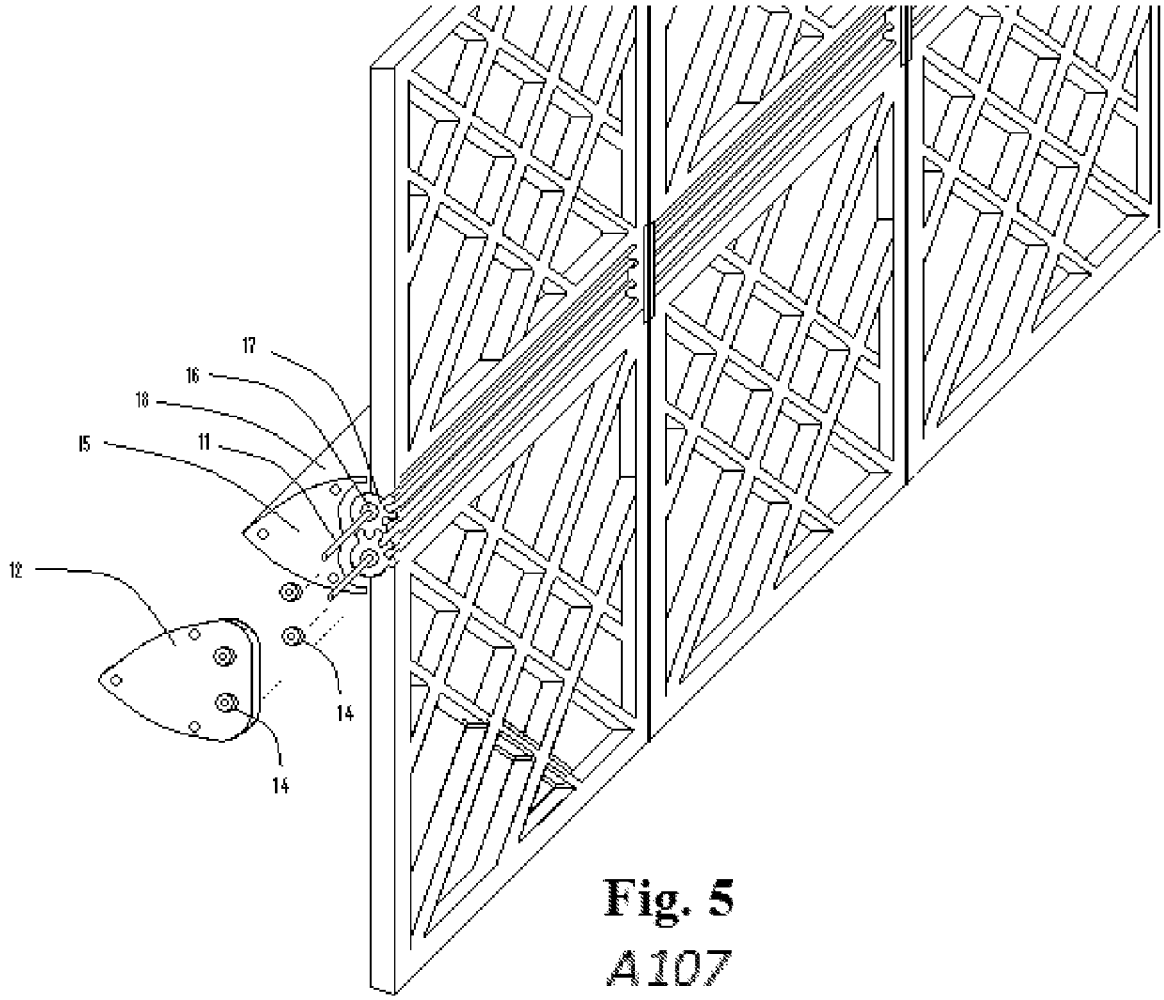
FIG. 5—Detail perspective drawing of a parallel geared pivot shaft wing assembly A107.
Figure 6A:
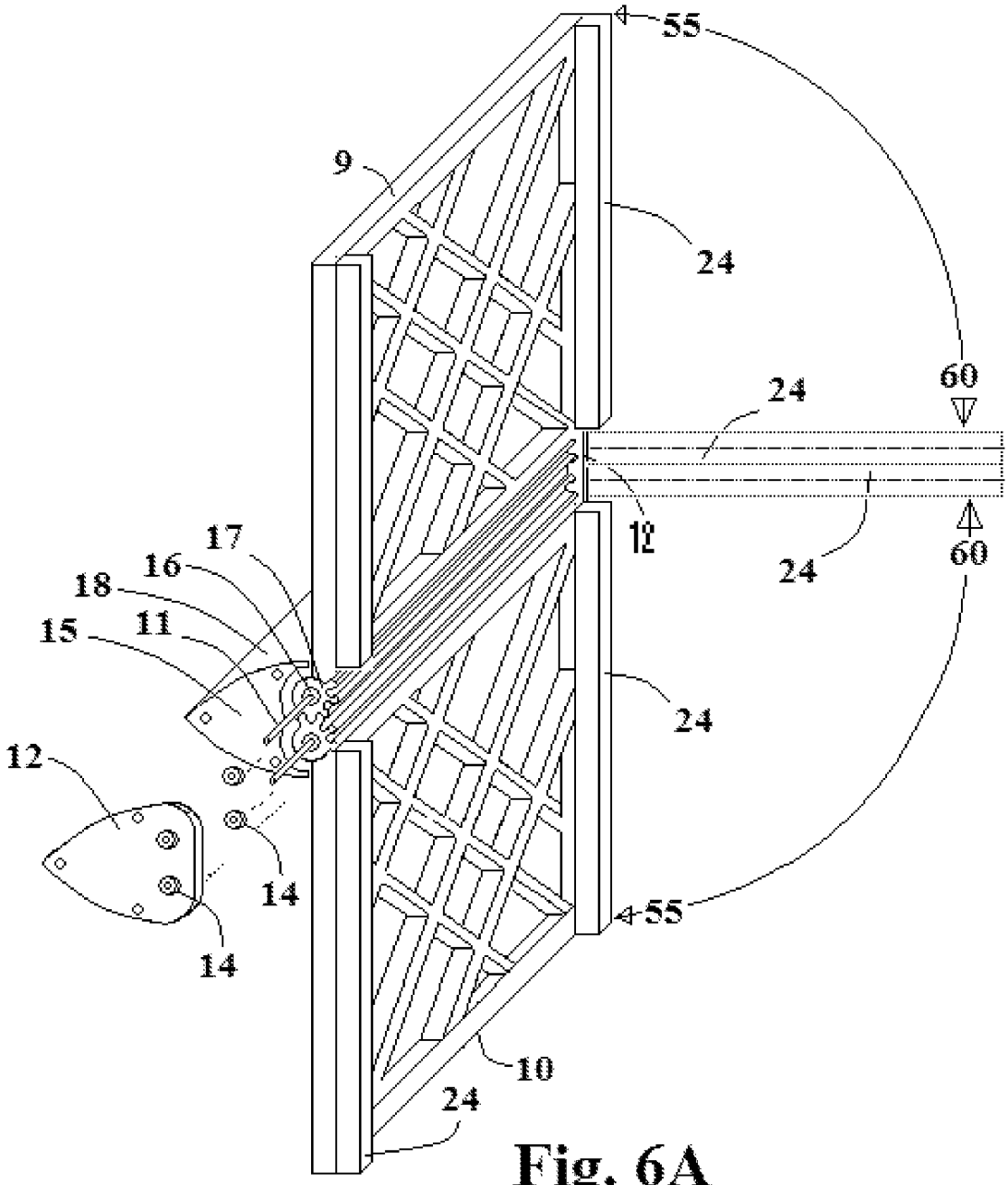
FIG. 6A—Detail of pivot shaft and wing assembly A106.

It is possible for a propulsion turbine to have a single pivoting wing assembly spanning diametrically across the concentric drive vector. The preferred embodiment however are wing assemblies with at least two opposed wings each with a respective pivot shaft. There A-104 is an opposed two winged unit with consolidated pivot shafts. A105 is a wing assembly consisting of multiple two winged assemblies in series with consolidated pivot shafts with gear box A109 as seen in (FIG. 4A) A106 is a opposed wing assembly unit with parallel pivot shafts. A107 is a multiply geared wing assembly with parallel pivot shafts as seen in FIG. 5. The parallel pivot shafts can be adjacent to one another as seen in FIGS. 5 and 6A or consolidated into one another as seen in FIG. 4A. The pivot shaft can pivot from the center of the interior operating space of the planetary turbine as is characteristic of type 1 and 3 planetary models, an example of which is seen in. FIG. 1 type 1 and FIG. 24 type 3, or the wings can be decentralized, each pivot shaft and wing assembly opposing the other and pivoting in from the perimeter defining the interior operating space of the planetary turbine as is characteristic of types 2 and 4. An example of which is seen in FIG. 21 type 2 and FIG. 23 type 4.

Each wing can be made of one panel, usually a elongated rectangular version of FIG. 6A or each wing can be made of multiple panels. Multiple paneled wing are illustrated in FIG. 2A and FIG. 4A wing assembly A105 and FIG. 5 wing assembly A107. Single panel wings may be preferred in class B models where the wing's sweep vector is parallel to the created current or the crafts trajectory and have drive-stops only serving the sides or ends of the wing adjacent to the end assembly 25 or side support structure 20. In other models where the wings in their concentric sweep vector cut across the direction of created fluid flow or thrust like class "A" it usually is preferable to have multiple paneled wings. With each of the two opposing wings divided into multiple wing panels the opposing hinged wings panels can be geared together each pair operating independently of the other pairs in the series as seen in FIG. 4A and FIG. 5. Thus the two opposing wings are counterbalanced. Each opposing pairs can open and close, one pair at a time as they enter into or leave the glide or drive side of the sweep area. This incremental transition reduces the overall transferred structural stress by dividing the combined stress of the transition of the whole wing assemblies by the number of independently operating pairs of wing A104 or A106.

A100 wings used in aircraft or water craft can in their concentric sweep vector both be made to operate parallel to the created current or the crafts trajectory and also transition and operate where the wings in their concentric sweep vector cut across the direction of created fluid flow or thrust. With techniques of prior art these machines can be mechanically or magnetically regulated to transition with multiple opposed wing units arranged in series deploying and detracting independently, one at a time, and/or the series of independent wing units can be locked together to retract and deploy in unison.

Where applicable the transiting multiple paneled wing pairs tends to increase production by increasing the individual length of the drive stroke in each pair of wing's drive cycle while lessening drag resistance in the wing glide cycle. Propulsion Turbine's with wings comprised of multiple independently opposing wing assemblies have two short transitional segments of a few ° of trans-drive meaning the rotational transitional interval into drive and trans-glide meaning the rotational interval into glide leaving the benefit of two longer fixed segments of drive and glide, increasing productivity by lessening drag resistance in trans glide increasing productivity by lengthening the drive cycle.

Figure 7:
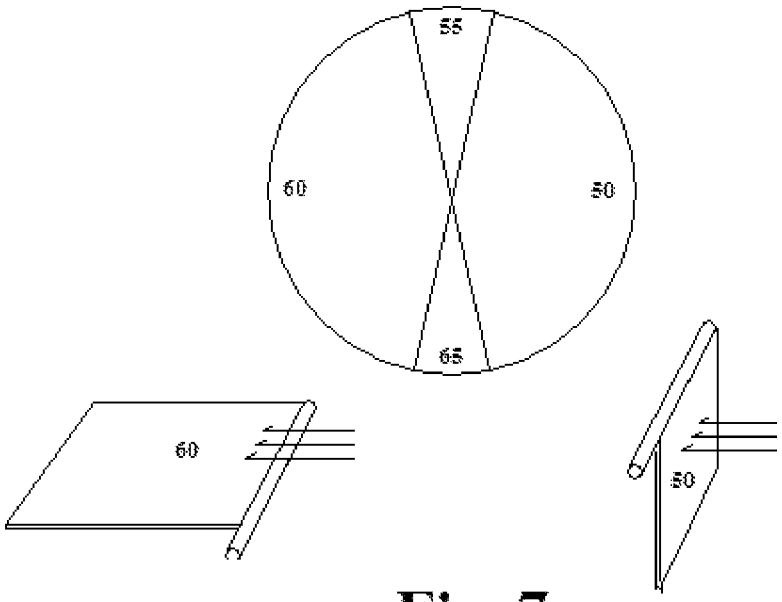
FIG. 7—Pie chart of the cyclical duration of the quadrants trans-drive, drive, trans-glide and glide.

This embodiment is illustrated in FIG. 7, showing the drive and glide cycles taking up the bulk of the 360° of rotation. The wing in glide at the bottom of the Figure is marked 60 showing its reduced glide profile relative to the impingement of fluid current, the wing in drive next to it is designated with the numeral 50 of drive showing its transverse relationship with the created fluid current or thrust.

Parallel Adjacent Pivots Shaft and Parallel and Consolidated Pivot Shafts:

Many models have pivot shaft running parallel and adjacent to one another as seen in FIG. 3 or the pivot shafts can be consolidated one inside the other in same fashion as a common hinge with one half of the hinge attached to one opposing wing and the other half of the hinge attached to the other as seen in FIG. 4A.

In the planetary turbine type 2 and type Four with decentralized pivot shaft as seen in type Two example seen in FIG. 21 the pivot shaft and wing assemblies are like the centralized pivot shafts that run parallel and adjacent to each other but instead of being centralized and adjacent to one another, pivoting out from the center are instead separated to the perimeter that defines the planetary turbine's interior operating space and pivot inward with wing tip meeting in the center of the wing's operating space.

A detail of the centralized pivot shaft models, both the parallel adjacent models and consolidated models are featured in FIGS. 4A and 5. The pair of parallel adjacent pivot shaft seen in the example in FIG. 5 can be moved apart and are adaptable in serving decentralized planetary turbines type 2 and type 4, each of the pair can optionally be geared together across the end assembly 101 or side structure 20, which ever be the case, to be connected to operate in tandem. In this example each of the planetary turbines has one compound winged assembly designated in FIG. 4A as either A 105, having consolidated tubular (hinge style) pivot shafts each, or as seen in FIG. 5, A107, having separate parallel tubular pivot shafts. Each of these compound assemblies is comprised of multiple independently operating two winged units designated A104 in FIG. 4 referring to the consolidated pivot shaft or unit 106 as seen in FIG. 6 referring to the parallel two winged pivot shaft unit. Each independent wing assembly is arranged side by side in a series across the central diameter of the planetary turbine forming the compound wing and pivot shaft assembly A105 FIG. 4 or A107 FIG. 5.

In this example the compound wing assembly 107 runs on two parallel stationary wing pivot axles 11 that span the diameter of the planetary turbine anchored at the middle of the planetary turbine's side structure 20 as illustrated in the moved out section on the right hand side of FIG. 3. One axle 11 serves as the pivot point for the wing pivoting up in the FIG. 5 designated by the number 9 and the other axle 11 serves as the pivot point for the wing pivoting down designated by the number 10. Note: part number 11 is the stationary pivot axle, part 16 refers to the wing's tubular pivot shaft. Each up wing 9 is geared to a down wing 10 forming one of several independently operating pairs designated again as assembly A106 as illustrated in FIG. 6.

Detail description of parallel two, winged pivot shaft models, units A 106 and compound A107 models are featured in FIGS. 3, 5, and 6. In this design the wing is attached to a tubular pivot shaft that rotates 90° back and forth into its drive and glide position on a stationary axle 11 that spans across the central diameter of the planetary turbine. Each wing of each parallel series pivots on its own independent tubular pivot shaft 16 rotating on pivot axle 11 each wing attached to it own independent gear 17 that runs in series the length of pivot axle 11 as illustrated in FIGS. 5 and 6. Stationary pivot axle 11 is attached to a side structure 20 at either or both ends of the wings pivot shaft as illustrated in FIG. 3.

Regarding FIG. 6, Both the up wing 9 and down wing 10 in each pair can be attached to their own tubular wing pivot shaft 16 and run on their own stationary axle 11 with the 9 shaft gear 17 engaged with the 10 shaft gear 17. In this example each parallel tubular pivot shaft 11 and gear 17 unit are geared to the other reversing each wings pivoting rotations. Consequently as down wing 10 transitions down into drive the up wing 9 of the pair transitions up into drive, and conversely the opposite is true as the wings transition into glide as also illustrated in FIG. 6. The attachment and reverse rotation of each wing allows each wing to be counter balanced with the other as shown. This arrangement also allows each pair to enter into and leave the glide and drive side of the sweep area independently as shown in FIG. 2A.

Figure 6B:
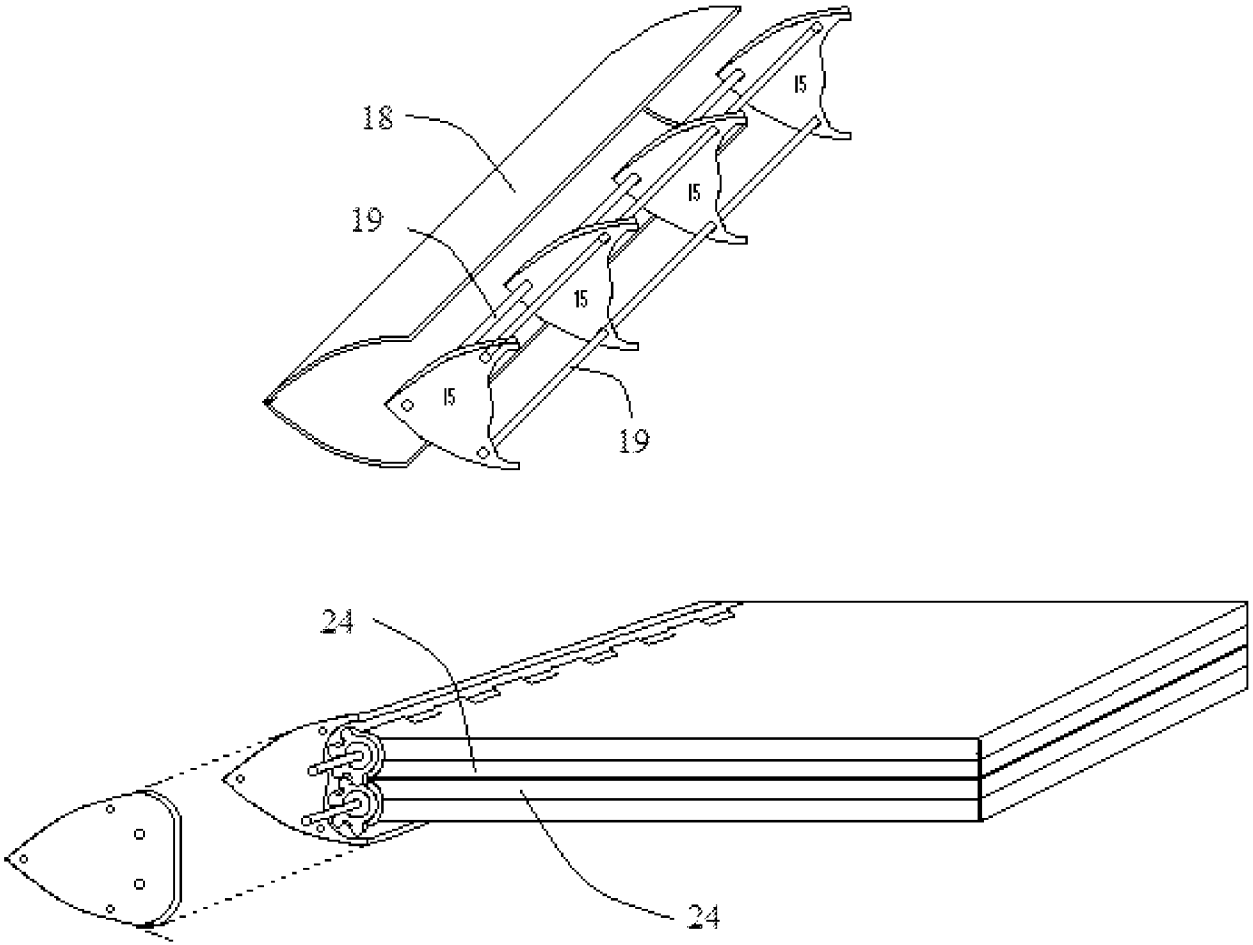
FIG. 6B—Exploded detail of nose ass. 108 on A106 of FIG. 6A.

As illustrated in FIG. 6B, nose assembly A108 serves as a robust support structure for the entire wing assembly and also serves as an aerodynamically designed leading edge to reduce drag to a minimum by shielding the entire wing assemblies 105 or 107 in its glide posture. In this example the nose assembly A108 is made in sections corresponding to each separate wing assembly in both A104 and A106. As illustrated in FIG. 6B each nose assembly is reinforced with ribs 15 and connecting rods 19 that run through the ribs attaching to the assembly's end plates 12. Each nose assembly is connected together with endplates 12 and appropriate fasteners to form, one continuous span from one end plate 12 to the other. The nose spans the entire series of opposing wing assemblies and is covered with a detachable smooth cover 18. Both stationary axles 11 as well as the ends of connecting rods and terminating endplates are thus attached as anchors to side support structures 20, or to end assemblies 25 whichever be the case. Side bearing 14 and thresh washers on each side of the endplates allow each A104 or A106 to operate independently without interfering with the movement of the adjacent wing assemblies.

Compound Consolidated Pivot Shaft Wing Assembly A105

Figure 4B:
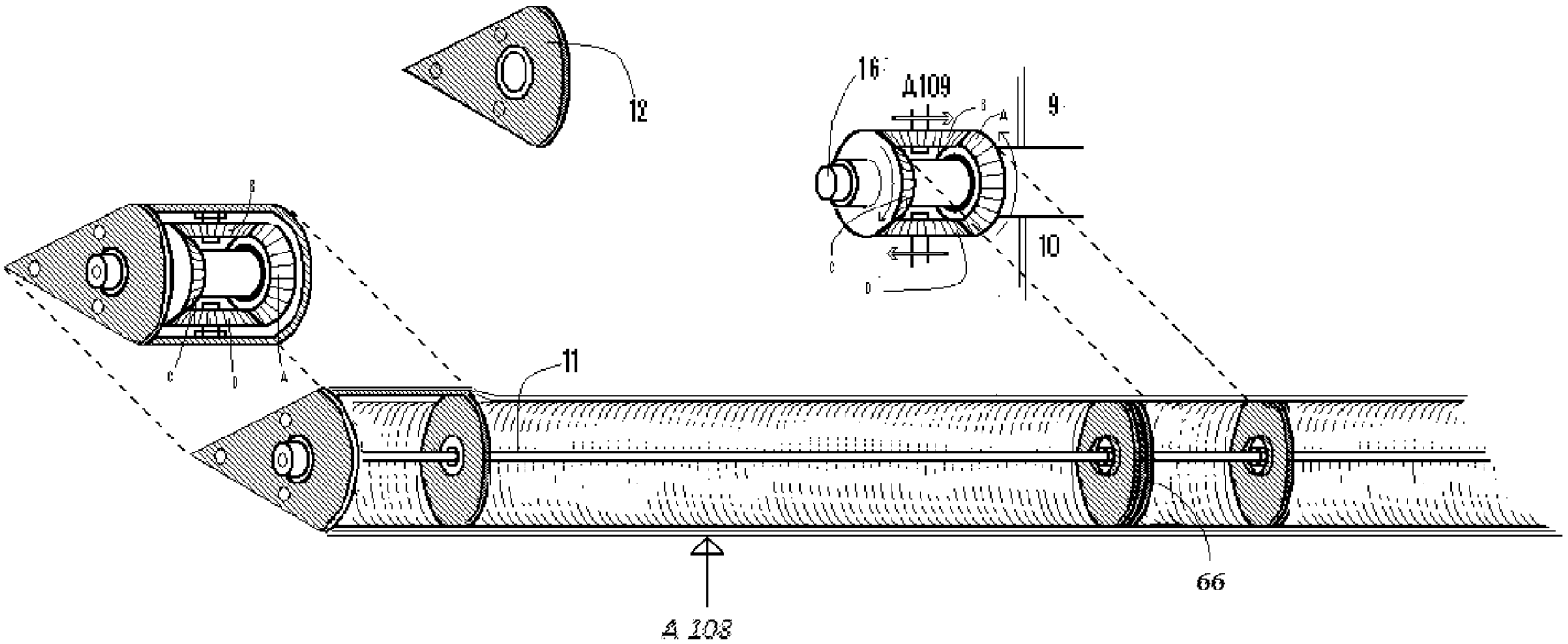
FIG. 4B—Parts detail featuring pivot shaft gearbox A109 and nose assembly A108.

FIG. 4, A105, the consolidated pivot shaft model, is a variation of A107 and is the same in most respect. One difference in the A105 relates to the opposing wing's gearing design. Instead of having opposing gears running the length of the two opposing wing sections A105 has its wing connecting pivot gears consolidated in a unit at one side of the wing in A109 see in FIG. 4A and FIG. 4B. Another difference is the consolidation of the pivot shafts one inside the other in a common hinge design. As seen in FIG. 4A each up wing 9 and down wing 10 is attached to its own pivot shaft that is one half of the hinge. Each wing and pivot shaft is also geared together like 106 also forming an independent two winged unit A104. The main advantage of this consolidated pivot shaft design is the reduction of the physical drag profile of the assembly in the glide side of the sweep area.

As illustrated in FIG. 4A the hinged-like pivot shafts are free to operate within the inner curvature of the stationary nose assembly 108 seen in FIG. 4B. Wing 9 the wing that transitions up into drive and its half of the hinged pivot shaft is connected to beveled gears A and B and the other wing 10 and its half of the hinged pivot shaft is connected to beveled gears D and C as illustrated in the upper left hand side of FIGS. 4A and 4B. Together each of the two gear sets comprise the reversing geared assembly A109 that like the counterpart in other pivot shaft designs simultaneously move the wings in the opposite direction counterbalancing the wing going up with the wing going down. The aerodynamically shaped tear dropped or pointed nose assembly A108 anchors to the planetary turbine's side structure 20 as seen in the moved out section of FIG. 3. Both nose and compound wing assemblies A107 and A108, serve as a reinforce support structured rigidly supporting the series of opposing wing assemblies 104 as they span across the diameter of the Planetary assemblies transferring the load to the planetary assemblies side structures 20.

In the wings approximate 170 plus degree segment of glide, the vessel's forward movement through its relatively still environment makes the wings immediately assume their sleek, streamlined glide posture of least resistance because the backstop assemblies are always in front of the wing's leading edge allowing the wings to drop away, always in fixed direction relative to the created current or the craft's forward movement as a natural consequence of this design. Because the inner portion of the opposing wings is never exposed to the glide side of the sweep area but shielded by the wing opposite smooth side in trans-glide, and concealed between the two opposing wings in glide, the texture of the drive side of the wing can be strengthened and reinforced with course cross ribbing as seen in FIG. 4A and the like and not cause drag resistance in trans-glide or glide, all the while increasing traction and fluid capture in drive as seen in FIG. 4A, FIG. 5 and FIG. 6A.

Drive Stop Accelerator

Figure 10A:
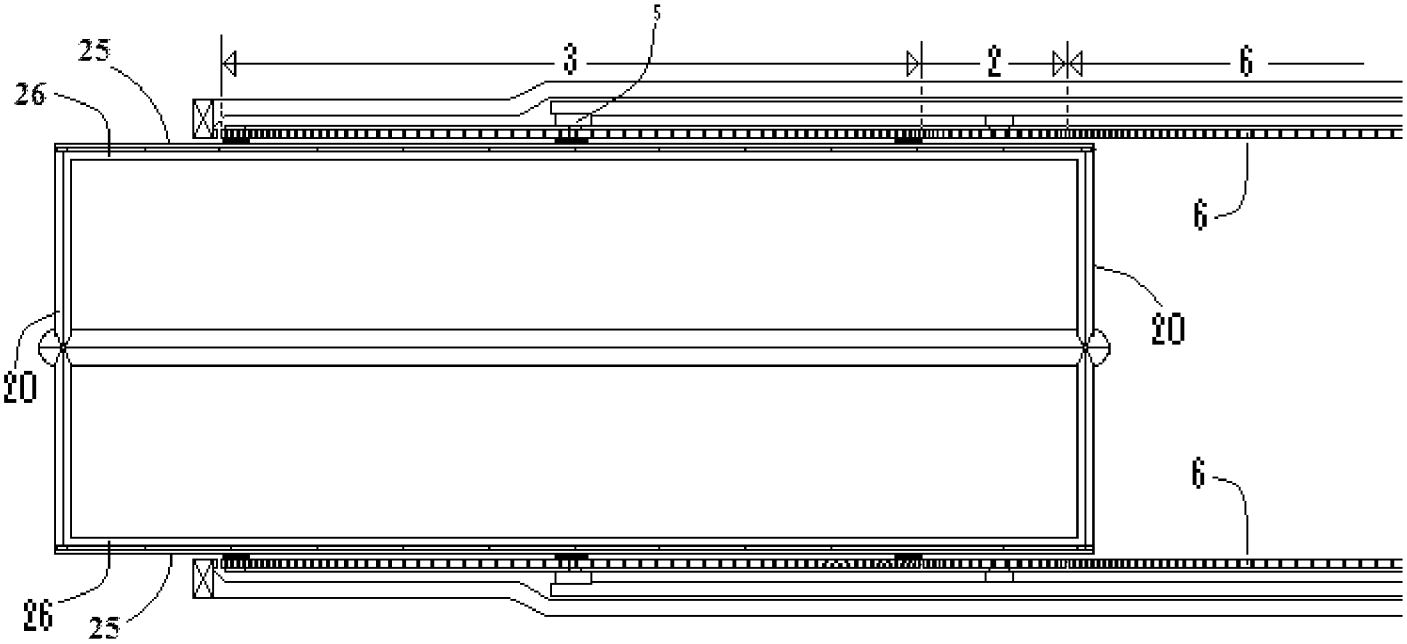
FIG. 10A—Side view of the unobstructed glide sweep area with the removal of vertical drive stops.
Figure 10B:
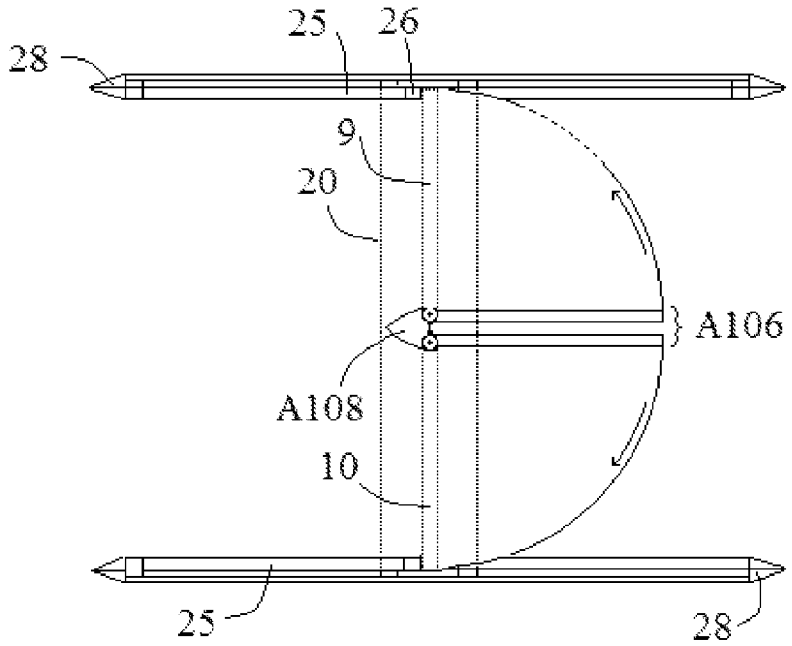
FIG. 10B—Side view of A101 with nose A108, and compound wing assembly A106.
Figure 10C:
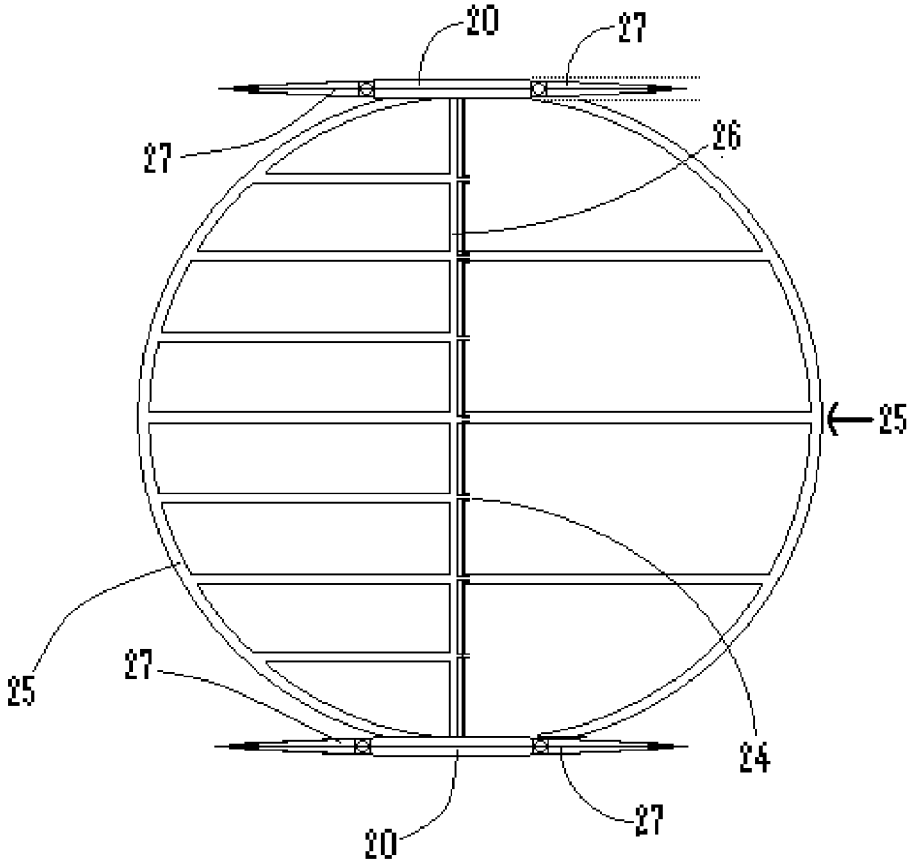
FIG. 10C—Top view of A101 showing stabilizers 27 robust structural braced drive stop in end ass.
Figure 10D:
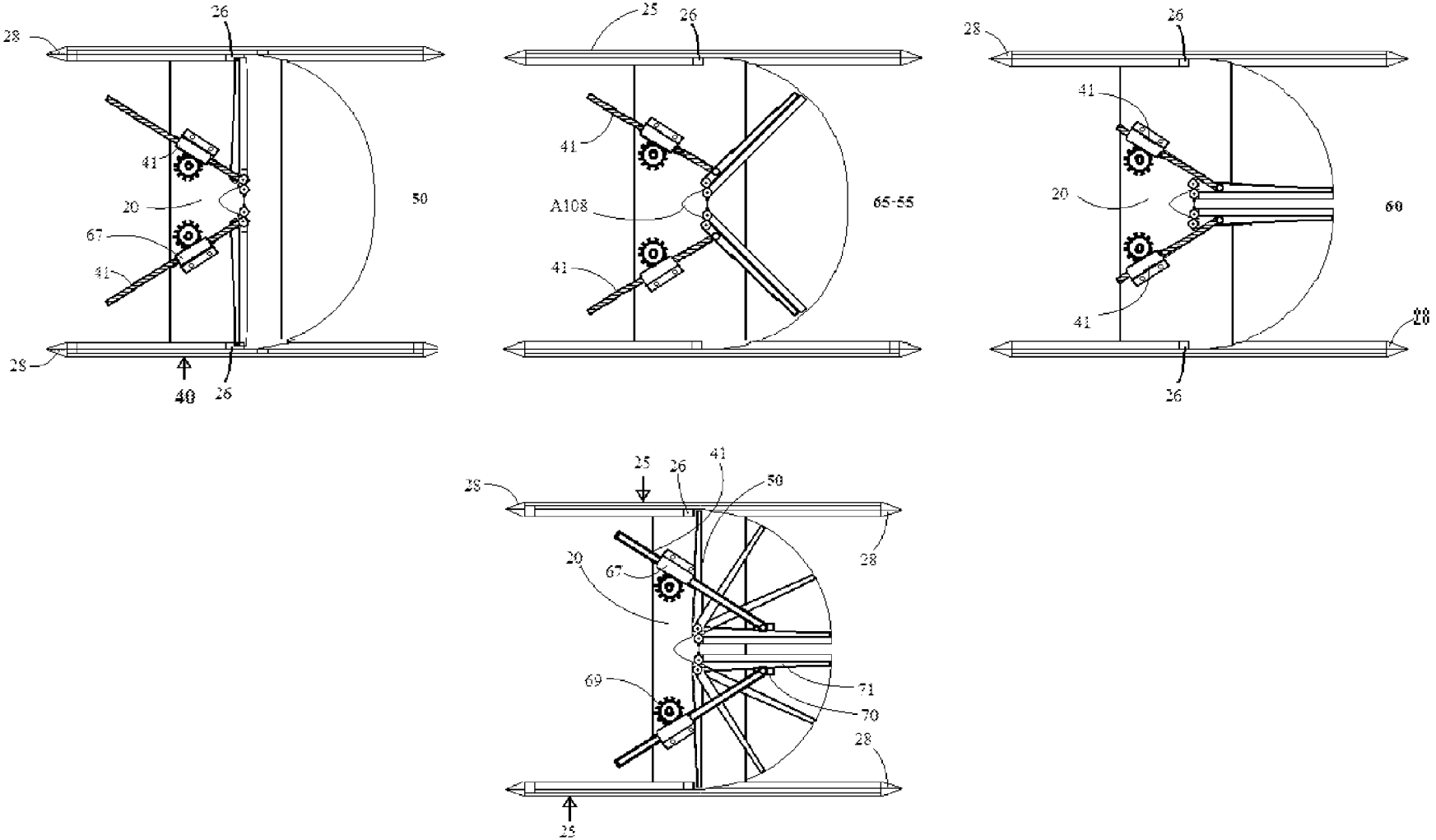
FIG. 10D—Concept drawing of the drive stop accelerator part 40.

The planetary turbine assembly include an optional pair of pivoting drive stop accelerators 40 for each opposed wing as seen in FIG. 10D. The pivoting drive stop accelerator defines and regulating in incremental ° the wing's angle of attack into the drive side of the sweep area. The drive stop accelerator has a drive stop assembly with a pivot axis at one end of its pivoting assembly joined to the planetary turbine frame in this example on side structure 20 and at the intersection of the wing's pivot shaft at the side of the wing, extending parallel with the side of each wing to be impinge upon by the narrow side perimeter of the wing in its drive position. The pivoting drive stop accelerator defines and regulating in incremental ° the wing's angle of attack into the drive side of the sweep area with said drive stop accelerator transferring a regulated force there through to the planetary turbine frame assembly, with said pivot shaft becoming incrementally rotatable from a glide position of net zero, locking the wings in glide, to any increment of drive angle up to 90° full deployment where wings are transverse to the direction of created current or thrust, thereby allowing the turbine to freely rotate at varying RPM controlling the current or thrust as desired with said drive stop accelerator activated by remote controls and the like and powered by an onboard power source. The drive stop accelerator 40 is shown in FIG. 10D has a rotation activating arm 41 that incrementally changes the angle of the arm seen in 4 wing positions, 50 drive 55, trans-drive, 65 in trans-glide and 60 glide.

There are many design know prior mechanical art to regulate in incremental ° the wing's angle of attack. One possible design seen in FIG. 10D, uses air pressure, hydraulic pressure, vacuum or electrical current to power a geared servo 67 that engages with pinion gear 69 anchored to side structure 30 that engages with a rack gear running the length of the activating arm 41 that is connected at one of its extended ends to a pivot joint comprised of axle bearing, and bearing housing 70 that is attached at the side of the wings drive stop 71. As the servo moves the activating arm forward and back the wing's drive stop attached thereto changes its angle thereby deploying and retracting the wing.

Note the image at the bottom of the Figure shows 4 multiple position 50, 55, 60, 65 super imposed, one on the other. Extracted from that drawing are those position shown separately for visual purposes.

The planetary turbine can include an on board electrical generator and storage cells and/or a compressor joined to the structure within the covered end assemblies or side support structure. This power can be used or gathered and stored as kinetic energy and converted into pneumatic, hydraulic or electrical energy to power the activator that rotate the drive stop accelerator to adjust the wing drive stop angle of attack in the drive side of the sweep area. A generator in the end assembly could be geared to the planetary turbines ring gear to generate power or an air inlet at the higher pressure area adjacent to the drive stops and drive wings could collect and store pressure either directly from the discharge pressure or from a compressor run off discharge pressure or vacuum.

Note: In some A100 models, due to one planetary turbine "shadowing" another, it may be desirable to have three instead of four planetary turbine. Although the examples in this document have four planetary turbines in every A100 it should be noted that working propulsion turbine and fluid current fans of this design can function with two or more planetary turbines.

The use of gears has been described above for engaging the intermediate reversing gears 2, 101 ring gear 3 and sun gear 6 to constantly maintain the transverse relationship of the rotating planetary and wing assembly 101 to the direction of created current or the crafts forward movement, or created thrust. This objective can also be achieved with the use of two of the four intermediate reversing gears or the elimination of the interjacent gear 2 all together by using flat-belts.

Figure 17:
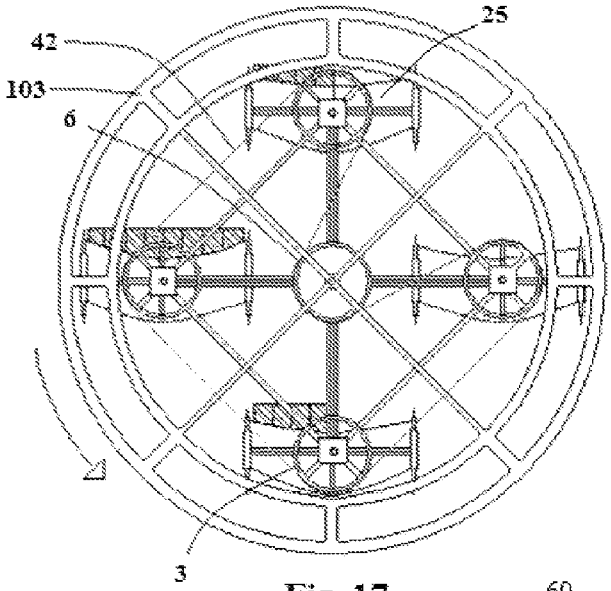
FIG. 17—Top view of an A100 with a serpentine flat belt drive in place of reversing gears 2.
Figure 18:
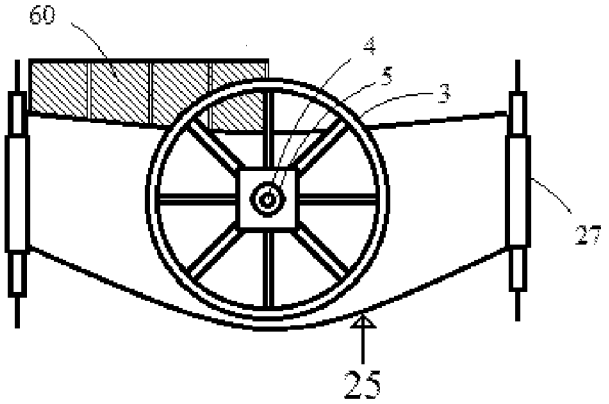
FIG. 18—Is a top view of A101 showing contoured end assembly 101.

As seen in FIG. 17 in one example, by using a serpentine flat belt 42 with gearing on both sides of the belt, one belt connected to the sun gear 6 and all the planetary turbines ring gear 3. This gearing arrangement, although not as robust will maintain the crucial one to one counter rotating ratio between the planetary turbine rotating on its axis and the interplanetary hub and central drive shaft counter rotating once around the central axis of A 100. In addition an idler wheel or gear can be added to enhance the connection of the flat belt to the stationary sun gears. Naturally, as the applied powers increases so does fluid displacement or thrust as does the opposing resistance force of the atmosphere on the vessel flying through space. This resistance is transferred from the drive wings to the planetary turbines mains shaft through the arms of the interplanetary hub assembly to the driveshaft and main bearing housing to the superstructure A103. An additional function of the rotating cross brace structure A102 is to unify and distribute these stress and force evenly throughout the turbine. Thus the planetary turbines are held in unison, evenly dispersing the stress, torque and centrifugal force on the drive side of the Super structure in their 360° of operation while maintaining both their respective drive and glide postures.

Although the sun gear and planetary gears are necessarily the same size, the intermediate reversing gears 2 can be of variable size and still perform the primary function of maintaining the one to one counter rotational ratio of each planetary turbine rotating once around A100's central axis and stationary sun gear 6 as the planetary turbine A101 rotates once around its planetary axle 4 as shown in FIG. 1A and FIG. 2A.

Figure 8:
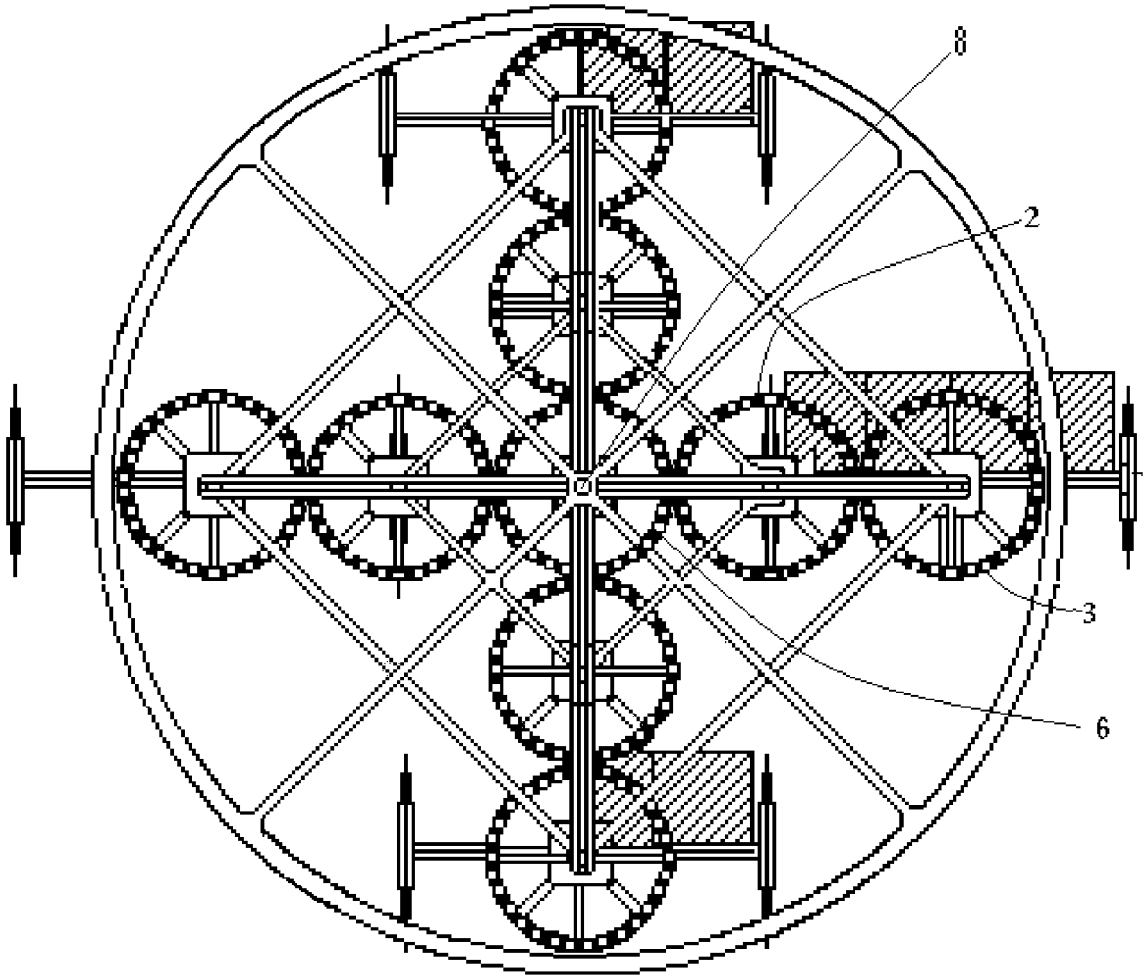
FIG. 8—Top view of the expanded radius turbine by enlarging the diameter of the reversing gear 2.
Figure 9:
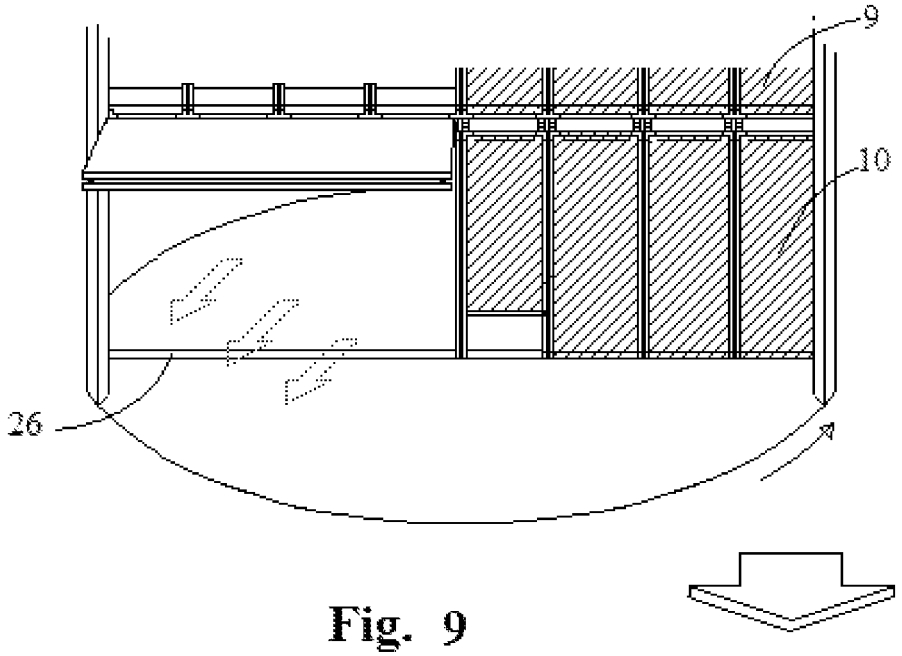
FIG. 9—Perspective view of an A101 with a recessed drive stop in the end ass. 25
Figure 11:
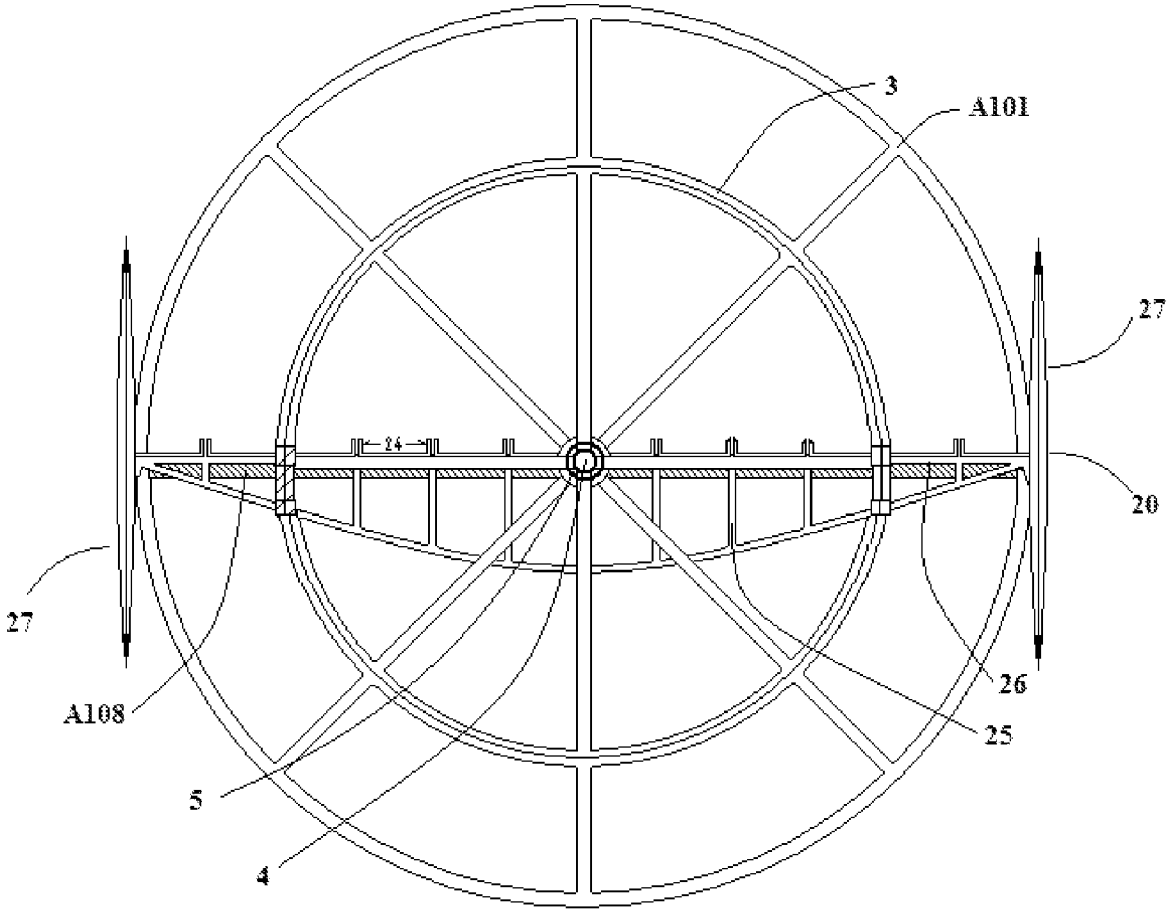
FIG. 11—Top view showing mini fairings 24.

FIG. 1A. In this model interjacent reversing gear 2 is relatively small. As illustrated in FIG. 8 when the diameter of the gear 2 increases so too does the super turbine's sweep area. As the radius of the sweep area increases so does the power per revolution generated in drive from the extended torque leverage transferred to the main shaft, as too does the power necessary to maintain the same rpm increase. Because of this feature it is easy to make a variety of extended radius models One notable feature of this expanded radius design seen in the example in FIG. 8 and FIG. 11 is the possibility of expanding the drive wing to extend further outside the diameter of the planetary turbine's end assemblies. Tests will show the optimum ratios of rpm to sweep area for different torque and velocity applications. With the advantage of enlarging the sweep area, the larger sweep area also offers a reduction of transmission heat buildup on the interjacent gear by dispersing the heat buildup caused from friction over a larger gear contact surface area.

Mini box fairing: As seen in FIG. 6A, the planetary turbine's panel of multiple wings can individually have mini box fairings, part 24, fixed to each wing emanating 90° out from the leading edge and both sides of the wing as illustrated also in FIG. 6B. The size of the mini fairings are restricted to the available space in-between the wings in their glide position. They serve the dual purpose of structurally reinforcing the wings while reducing the lateral escape of captured atmosphere off the sides of the wings in drive while adding little if any drag resistance in trans glide and glide. Because the side of the wings that engage with the current in drive is never exposed to the current in the glide cycle, radically cross-ribbed robust wing designs are made possible, enhancing traction without creating fluid resistance. FIGS. 4, 5 and 6 shows an example of this inter wing bracing, serving both as structural support for the wing and to capture current in conjunction with the wing's mini side fairing. These cross-braced surfaces are desirably exposed to capture and inhibits lateral atmospheric escape in drive. Because they are shielded by the smooth side of the wing in trans glide and glide tucking inside the two horizontally closed wings, this deeply textured design creates little if any drag resistance with the oncoming current in transition to or in glide.

It is because of this structurally robust wing design that the vertical backstop assemblies serving the sides of the wings can be completely eliminated as illustrated in FIG. 10A. The elimination of multiple side wing backstops running vertically through the glide cycle, dramatically decreases the drag resistance of the planetary turbines in the glide side of the sweep area and consequently increases efficiency. In this Figure the only obstruction between the side support structures 20 in the glide profile of this type one planetary turbine 101 is the aerodynamically shaped nose assembly A108 extending horizontally between the two side support structure 20, centered between the two end assemblies 25.

As illustrated in the side view of FIG. 10B, by slightly extending the length of the wings, the remaining upper and lower drive stop assemblies 26 serving the extended ends tip of the wings in drive, can also be placed out of the turbulence of the sweep area by being recessed in a cavity corresponding to the wing in the upper and lower end assembly 25. Out of current stream is the glide side of the sweep area the drive stop 26 that absorbed the greatest portion of the wing impact, can be structurally cross braced sufficiently strengthened within the covered interior of the end assembly while causing a minimum of drag resistance or turbulence, as illustrated in FIG. 10C.

Note: in regard to FIG. 10B the dotted lines represent a transparency of the side structure 20 and the area within marked 9 indicates the position of the upper wing in drive and the area marked 10 below indicates the position of the lower wing in its drive position.

FIG. 10E shows another perspective of turbine with the side wing drive stops removed. From the opposite side the lower drive stop 26 from this side is seen as a step in the otherwise smooth turbine disc inner cover. The crosshatched wings have just entered into the drive side of the sweep area and are rotating towards the viewer the lower wing panels #10 have transitioned down into drive and their apposed wing #9 above have just transitioned up into drive the opposed wing on the left side are still in the glide side of the sweep area with their wing pivoted in toward the viewer, the A101 planetary turbine is moving through space away from viewer as the drive wings are moving towards the viewer because the planetary turbine is flying through space away from the viewer the ambient fluid in its surrounding freely flows over the step and smooth cover of the end assembly Because the fluid current blows over the top of the recessed backstop there is no resistance to it in glide, and in drive the step actually increases traction. In this FIG. 10E the tear dropped nose of A108 is on the other side of the wing assembly so is not seen.

In this type 1 design with the removal of the wing side backstops and the removal of the obstruction of the entire upper and lower backstop structure by recessing them in the end assembly, the only obstruction in the glide side of the sweep area in between the side structure is the pointed or teardrop nose assembly A108 shielding the series of wing assembly A104, and A101's aerodynamically shaped end assemblies 25 as shown in front view FIG. 10A and side view 10B. In the class A type 2 and class B type 2 design where the wing's sweep vector is parallel or perpendicular to the created current or the crafts trajectory and the pivot shafts are decentralized relative to the planetary turbines, and perpendicular to the central drive shaft as seen in FIG. 21, even the tear dropped shaped wing assembly can be removed as a drag factor in the glide side of the sweep area, by decentralizing the wings pivot axis from the center of A101, placing one pivot shaft and wing on one end assemblies (type 2) or side structures (type 4) and the other opposing wings on the other, each wing pivots into a built in recesses in the end assembly 25 or side structure 20 in glide presenting a smooth exterior surface thereby not adding to the drag resistance of the end assembly or side structure.

Since the upper and lower circular discs shaped end assembly 25 of the planetary turbine A101 never change their forward facing relationship with the direction of forward movement of the craft or created current, they also, like assembly A108, have a pointed or teardrop aerodynamically shaped leading edge 28 that surrounds the rim of the upper and lower disc as seen in FIG. 10 image B.

Supporting Side Structure and Attachments

FIG. 10C shows the wings in their drive position with only their mini fairings 24 showing from this top view perspective. This Figure also shows the robust structure of the end assembly 25 reinforced to take the drive load of the wings also seen in the side view of the end assembly in FIG. 10B. Because the wings always face forward into the direction of travel or created current the side structure 20 or that opposing portion of the perimeter of the planetary turbine that is perpendicular to the wings like end ass. 25 and its attachments can be relatively long and narrow as illustrated in top view FIG. 10C In this example the side structure is lengthened even further with optional stabilizing fairing 27. This offers a large side surface that can dramatically increase fluid loading and prevent the lateral escape of large quantities of captured ambient air or water in the drive cycle. Because this side support structure 20 always stays in line to the direction of created current or the crafts forward movement, equal pressure consistently is evenly placed on both sides of its pointed or tear dropped symmetrical leading edge so that its sideways lateral movement across the sweep area creates only the minimal resistance nearly equal to a stationary like facing surface.

For example the likeness of this minimal resistance can be experienced by putting one's hand out of the window of a moving car and pointing ones fingers perpendicularly into the wind while moving the hand laterally keeping the fingers pointing into the moving direction of the vehicle. The stabilizing fairings 27 of each planetary turbine are always working in concert with the stabilizing fairings on the remaining three or so planetary turbines. These stabilizing fairings are especially useful in stabilizing the interplanetary assembly A102 in concert with each of the other A101 planetary turbines that have wings in drive or glide stabilizing the other planetary turbines that have transitioning wings going into drive or glide. Tests will show the size and productivity of the side structure and stabilizer/fairing relative to application and the radius of the Super turbine's sweep area.

FIG. 10B shows a side view of a wing structure made of a series of A104 compound wing assemblies. This side view also shows the end assembly 25 with its tapered leading edge 28 that is aerodynamically shaped to decrease drag resistance.

FIG. 10A shows a side perspective the recessed drive stop 26 that allows the glide currents to pass over the top smooth surface of the end assembly without increased drag resistance as seen in the perspective view of 10E.

As example FIG. 2 shows, the wings, drive stop assembly, side support structure/stabilizers outside of the circumference of the planetary making use of the available sweep area under the interjacent reversing gear 2 and portions of the stationary sun gear 6. This expansion naturally is limited by the operating space of the adjacent planetary turbines A101. The planetary turbine can stay within the size of the planetary turbines circumference or the side structure and upper and lower cylinder covers wings and drive stop assemblies can be extended out to encompass a portion of the larger available sweep radius, as shown in FIG. 2, 10A, 11 and others. This extension is possible as seen in these examples because all three drive gears; planetary ring gear 3, sun ring gear 6, and reversing gears 2 operating space are above their upper or below their lower corresponding end assemble of planetary turbine as illustrated in side view FIG. 10A.

FIG. 17: The examples of end assemblies 25 of planetary turbines A101 heretofore have been circular or semicircular although the perimeter shape of assemblies A101 can vary. FIG. 17 is an example of an aerodynamically contoured A101 showing a rectangular curved shaped upper and lower end assembly 25 on the A101 at the top of the Figure. Tests will show the size and shape ratio of the assembly 101 relative to application and the radius of the propulsion Turbine's sweep area. As stated above the orientation of the wing's pivot axis within the perimeter defining the operating space of the planetary turbine relative to the propulsion turbine's central driveshaft defines the type of planetary turbine. Above we have seen type "One" in FIG. 1A and FIG. 2A centralized pivot shaft perpendicular to A100's central axis.

In FIG. 23 is an example of an A100 with a plurality of A101 type four planetary turbines with the wing's pivot axis decentralized and parallel to A100's central axis. The opposed wing's pivot shafts 16 pivot on stationary axles 4. In this example pivot shaft 16 and stationary axle 4 function in the same capacity as the side support structure 20 and/or optionally can be mounted on the side support or within side support 20, extending between and joining A101's two end assemblies 25. The opposed wing of the planetary turbine A101 at the top and left of the Figure are in drive 50 rotating towards the viewer as the wings in the planetary turbine at the bottom of the Figure are in the minimum drag profile of glide 60 rotating away from the viewer, the upper wing in the planetary turbine on the far side of the Figure is in trans-drive and its lower opposed wing is still in glide.

In FIG. 24 is shown an example of a type Three A101 with centralized wing pivot shafts 16 within the perimeter defining the operating space of the planetary turbine A101 with its wing's pivot shaft 16 and pivot axis parallel to A100's drive shaft 7 and central axis. In this A100 the four type "Three" planetary turbines A101's opposed wing's pivot shafts 16 are of a consolidated hinge style A105 shaft assembly detailed in FIG. 4A that rotates on A101's stationary axle 4 that also serves as A101 central support structure and central axis extending between A101 two end assemblies 25. The A101 at the top and middle left of the Figure have their wings deployed in drive 50, the wing of the A101s at the bottom and back of the Figure are in glide 60.

Figure 25:
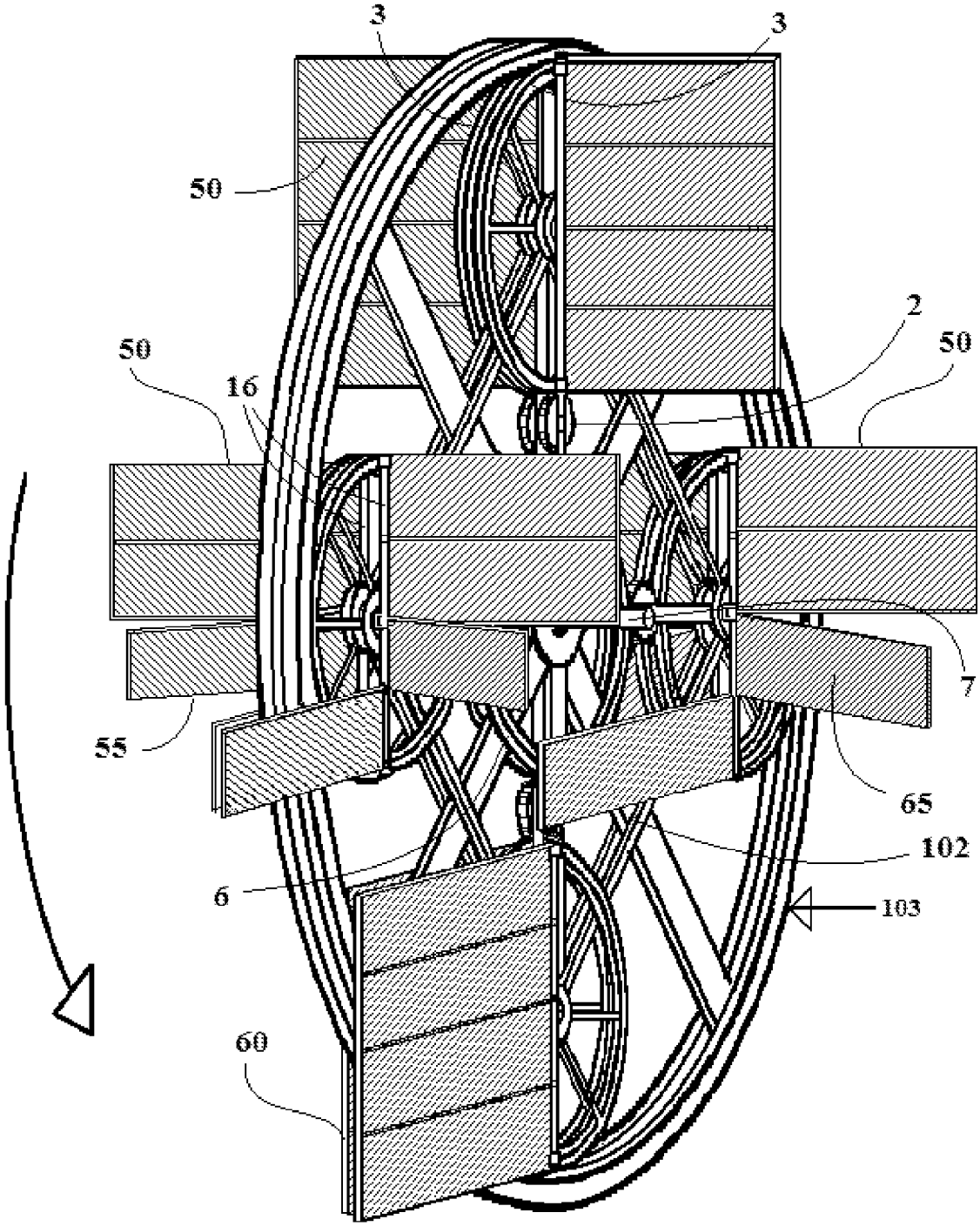
FIG. 25—Perspective view of exceptional design that has the two end disc assemblies of super structure 103 adjacent and side by side forming superstructure A103 in the center of the turbines operating space with wings pivoting out from their corresponding side of superstructure 103.

In regard to FIG. 25 heretofore all planetary turbines A101 have had two end assemblies 25 with the corresponding pivot shafts and wing assemblies arranged in between the perimeter containing both end assemblies. In FIG. 25 is an exceptional design that has the two end disc assemblies of super structure 103 adjacent and side by side forming superstructure A103 in the center of the turbines operating space. A103 holds and supports the central drive shaft 7 that is connected to two interplanetary turbine assemblies 102, one 102 on each side of the superstructure 103. Each interplanetary turbine 102 holding and supporting a plurality of 101 planetary turbines, with each 101 only having one end assembly 25. The planetary turbines each have wings that pivot outward from their end assembly and A100's centralized superstructure A103 to their drive stop in drive, a drive stop that can be incorporated in the wing assembly or be part of the superstructure, and retracting inward to a minimum drag profile against the superstructure in glide.

In regard to FIG. 21 completing the 4 types of turbines FIG. 21 is an example of a type Two planetary turbine 101. The wing's pivot shafts are decentralized relative to the perimeter that defines the inner operating space within the planetary turbine assembly A101 and perpendicular to the propulsion turbine's central axis. Each opposed pivot shaft 16 is attached to one of the opposed end assemblies 25 and pivot their corresponding wings inward to position drive 50.

Figure 26:
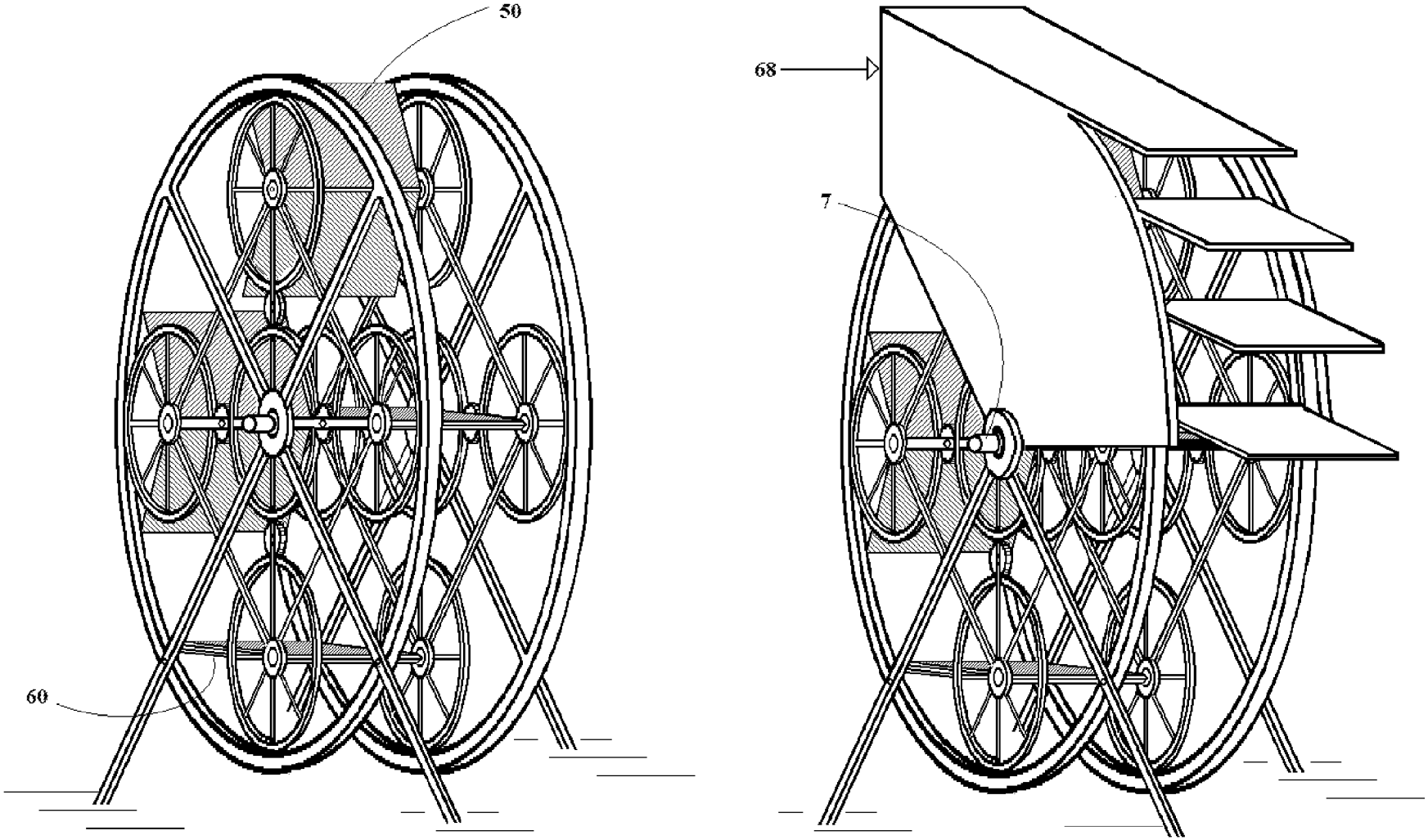
FIG. 26—Perspective view of two A100. One type one class B propulsion turbine A100 without high pressure vent and one equipped with high pressure vent 68.

In regard to FIG. 26 the turbine featured is a glass "B" type three turbine seen without its discharge vent 68 on the left and on the right the turbine has the discharge vent installed. The function of the vent is to direct, funnel and or concentrate the current discharge of the turbine and can have a variety of shapes.

Twin Turbine

Note: Because the A100 creates thrust or current predominantly on the drive side, approximately one half of its sweep area, if not tethered in place or coupled to another counter-rotating A100, the unbalanced discharge will spin the single un-tethered turbine out of control. Therefore when operating in the capacity of a fan the body of the fan must be grounded or tethered in place or have an identical A100 mirror its movement sharing a common frame. The same dynamic is true when the turbine is used to propel a craft. When two A100's working in tandem are attached to the same stationary assembly each A100 having opposing drive quadrants will obtain dynamic stability and balance, counter-balancing and neutralizing each propulsion turbine's torque to net zero.

The propulsion turbine A100 with its rotating centralized main shaft 7 naturally has one half of its sweep area on one side of the main shaft and one half on the other. One side becomes the 180° drive side and the other half becomes the 180° glide side, determined by which direction the propulsion turbine is rotating. As seen is FIG. 14. Thus, reversing the rotation of the main shaft reverses the drive and glide sides of a propulsion turbine's sweep area.

Figure 12:
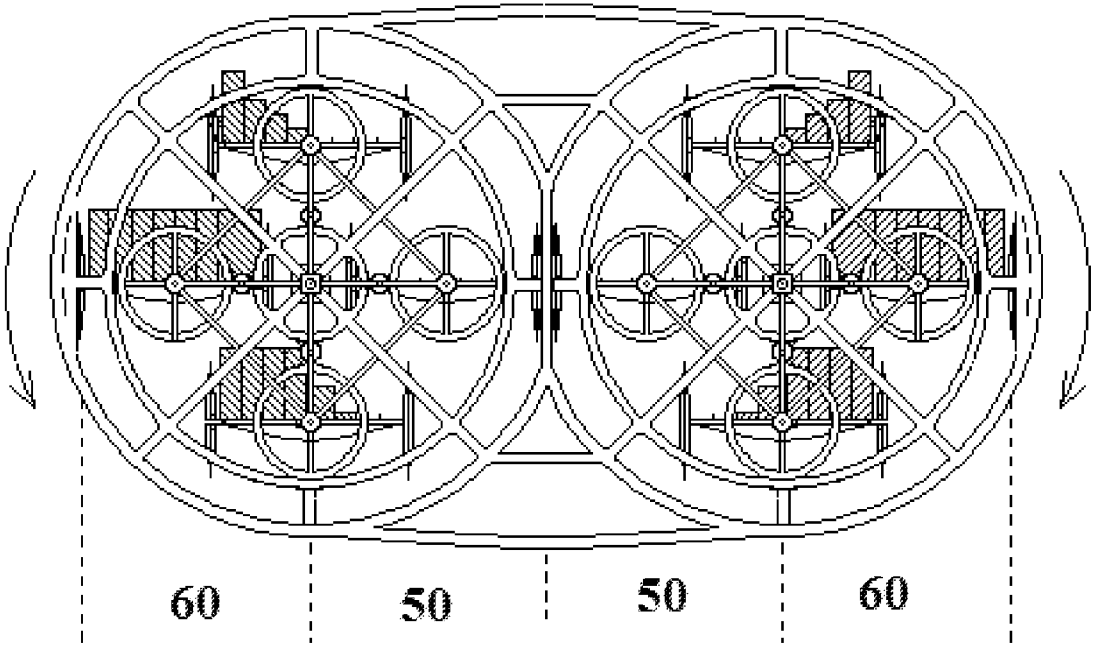
FIG. 12—Top view of a twin 200 showing glide and drive quadrants.
Figure 13:
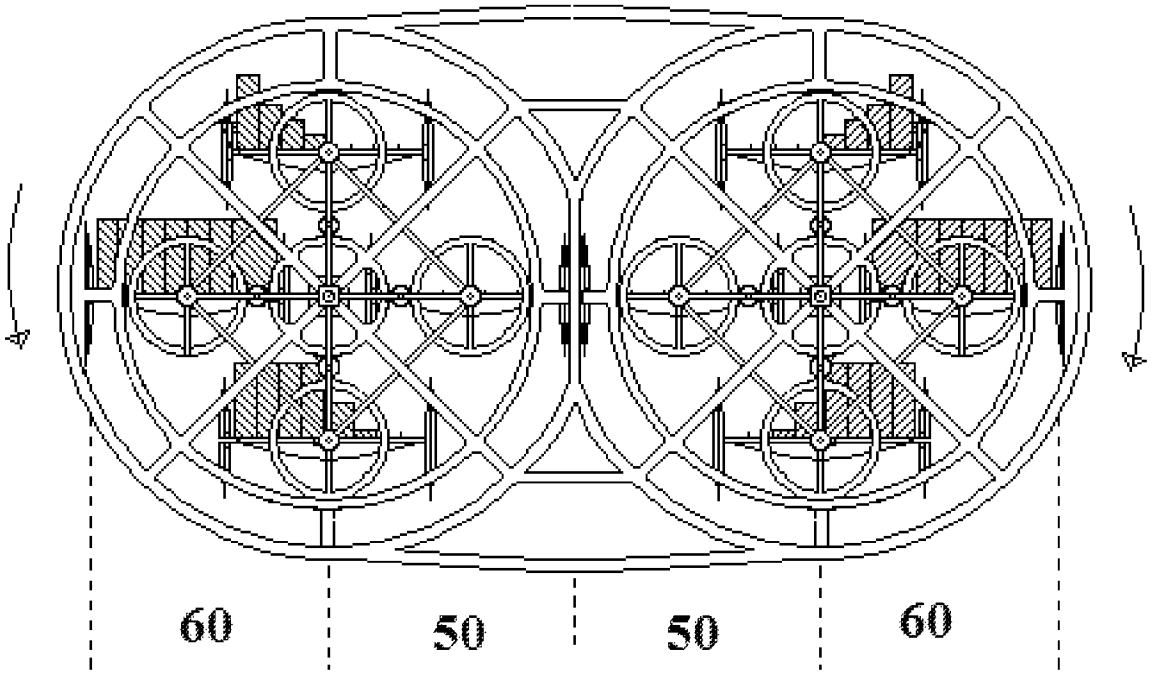
FIG. 13—Top view of a twin 200 showing glide and drive quadrants.
Figure 14:
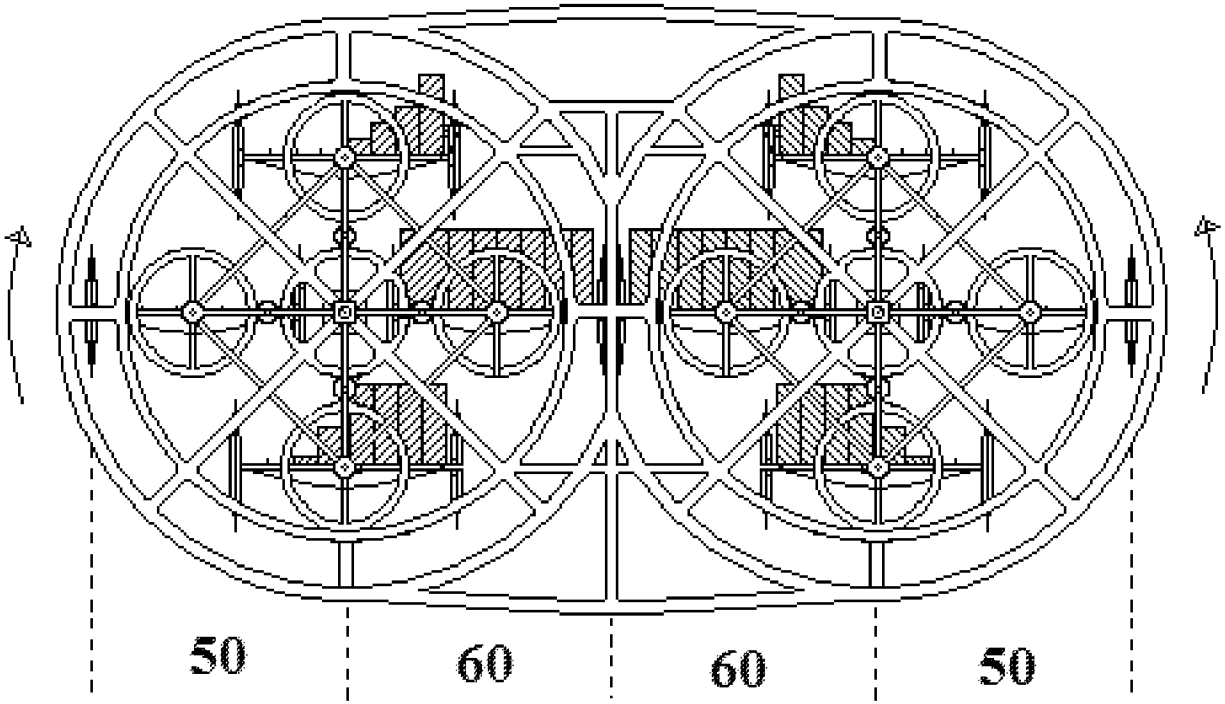
FIG. 14—Top view of two A200 Twin with drive and glide quadrants reversed.

Because the wings of the propulsion turbine's planetary turbine A101 create the forward thrust exclusively on the drive side of the sweep area, as seen in FIGS. 12 and 14 top view the propulsion turbine's transferred stress is almost exclusively applied to the drive side of the super turbine's central drive shaft 7. In addition to these unbalanced structural stresses is the greater problem of unbalanced fluid discharge and thrust. Thrust being applied to only one side of the propulsion turbine's outer structure, if not tethered or grounded would force the single A100 Turbine and its attachments to spin in circles. To balance thrust, achieve the trajectory of forward movement and eliminate the imbalanced torque stresses two A100 of the same size must be incorporated creating a Twin propulsion Turbine as seen in top view FIG. 12 and perspective view FIG. 16B. The additional A100 turbine counter rotates to dynamically counterbalance all moving parts and forward thrust creating a twin propulsion turbine, "A200". The model A200 featured in FIG. 12 has its drive sides 50 of each A100 adjacent and centered in the twin turbine's twin superstructure. In top view FIG. 12 the wing in glide are crossed hatched on the outer sides of the super structure.

In FIG. 14 there are two A200 illustrated in this Figure. The A200 in the upper half of the Fig, like FIG. 12 has its drive sides 50 of each A100 adjacent and centered with the wing in glide crosshatched on the outer sides of the super structure. The lower A200 in the lower half of FIG. 14 has its drive sides 50 apart and decentralized on the outer sides of the super structure with the glide sides 60 centralized with the wing in glide shown crosshatched, adjacent and centered within the superstructure.

Switching the Drive Sides of the Twin Turbine A200:

As previously stated, by reversing the rotation of each of the twin turbines counter rotating A100, the drive 50 and glide side sides 60 of the sweep area exchange places. Because of this feature each propulsion turbine A100 can have both of the drive sides together in the middle adjacent to one another or be switched having the drive sides on the outer side of the sweep area as illustrated in FIG. 14. This versatile feature allows the intake and discharge fluid on the drive side to be directly funneled through the inner or to the outer two sections of the sweep area as desired, serving many practical applications.

Figure 16A:
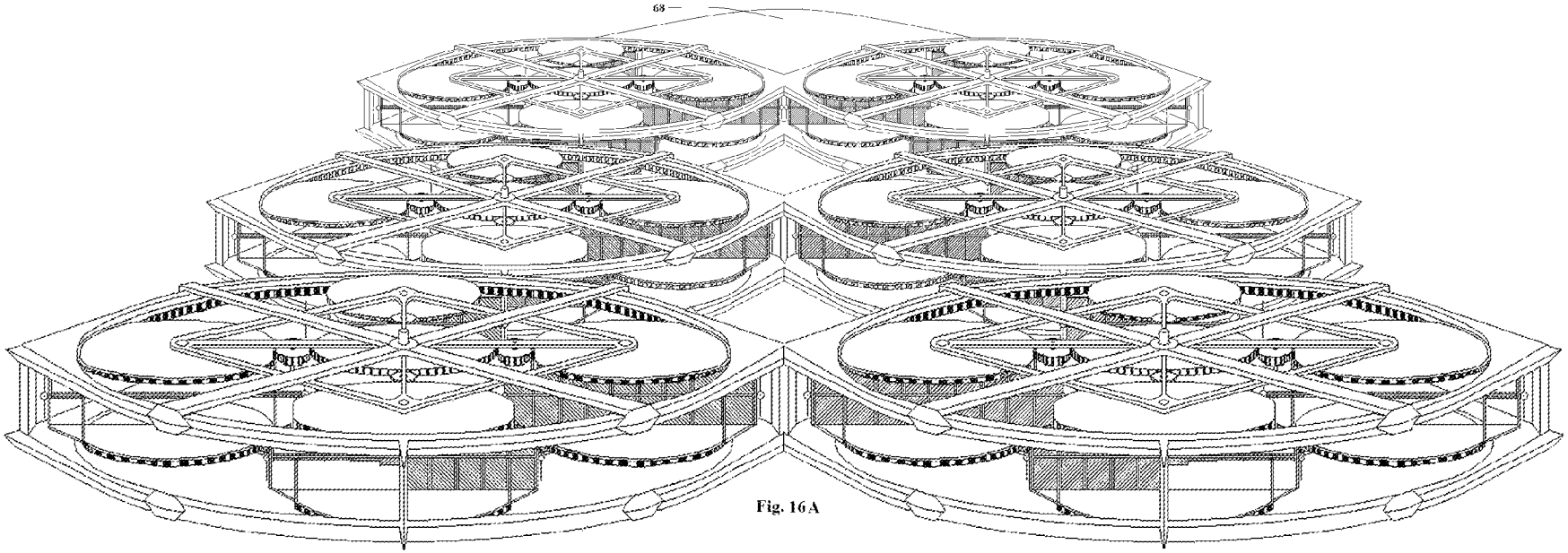
FIG. 16A—Compressor turbines arrayed in series with high pressure discharge vent 68.
Figure 16B:
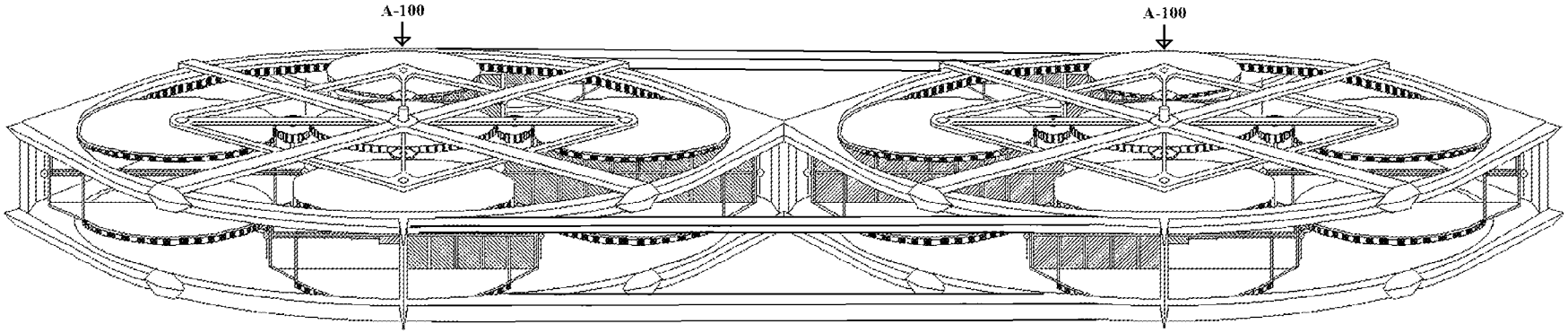
FIG. 16B—Perspective view of A200 twin propulsion turbine.

Because the A100 is scalable and can be produced in a large range of sizes, and with the ability to direct the drive intake and discharge streams of each A100 they may be arranged in balanced arrays, in a series or in multiple groupings of many sizes and configuration to do useful work, such as, to serve as fluid current fans, compressors, propellers for water, water or air or watercraft or aircraft water pumps etc. Since the propulsion turbine can also be placed horizontal or vertical and created vacuum causing levitation from drive assembly is not a problem it offers many unique advantages in water over conventional screws. FIG. 16A shows an array of twin A200 arranged in series. Each Twin can be a progressive stage for high higher pressure discharge. In this Figure the discharged current of the compressor is funneled into a vent or venture 68 to narrow the discharge profile to elevate and/or regulate pressure. Note: The designation line from 68 points to the outer top of the vent. FIG. 26 also shows a class B Type 3 A100 with a vent cover also funneling the discharge into a tighter envelope thereby increasing discharge velocity and/or pressure.

Figure 15:
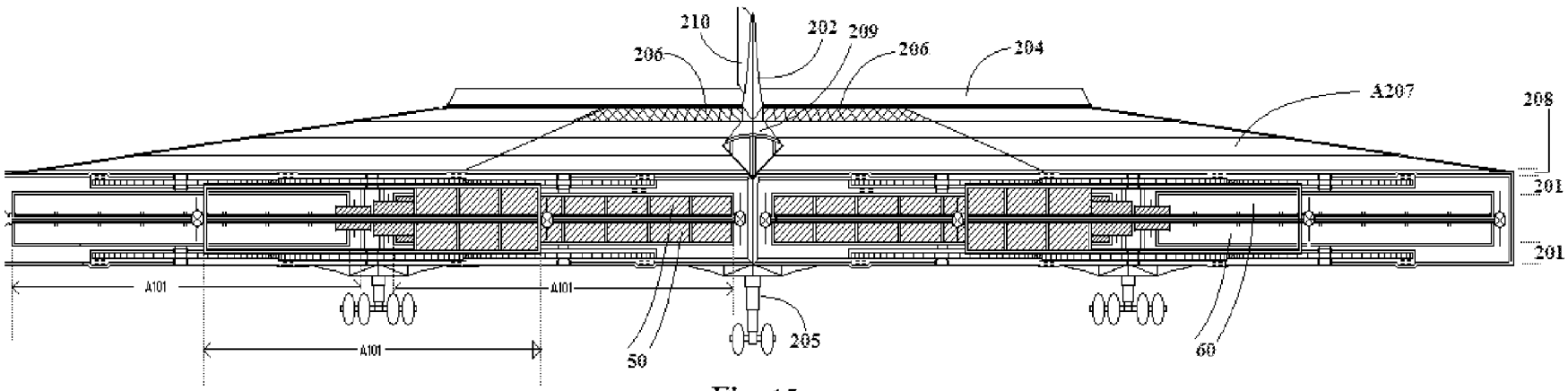
FIG. 15—Conceptual illustration of a high altitude solar powered Biplane A203.

FIG. 15 is a concept drawing of an ultra light aircraft A203 with twin A100 constructed of graphite composites and/or other light weight materials with a plurality of A100s combined within a superstructure A103 arrayed and arranged in series with the upper wing of a biplane having a flat upper deck surface made for supporting a large array of photovoltaic cells that transfer their generated solar energy to converters that store and power motors that rotate the turbines wings, displacing ambient fluids, creating thrust to propel the biplane style aircraft.

The present invention maximizes the frontal contact area of the turbine's wings so a large fraction of the energy generated by the solar array is converted to thrust. Because of the large frontal contact surface of the wings it is believed that these propulsion turbines can maintain traction in the thin upper atmosphere better than propeller arrangement, and that the turbines can thus power the aircraft to higher altitudes. Note: that the twin turbines are counter-rotating, so that there is no net torque applied to the aircraft which would otherwise cause the aircraft to pitch up or down.

The aircraft is equipped with landing gear 205 for landing and taking off. Design for lightweight cargo A variety of fuselage 209 or cargo bay, part 206 could have many shapes and placements designed above and/or below the deck structure of A103. This example shows two cargo bay doors 206. A conventional style rear-mounted tail 202 and rudder 210 provides steering capability, vertical stability could be provided with conventional elevators flaps and/or ailerons (not shown) to control altitude. It should be noted however, that the turning radius of the twin craft can theoretically be achieved by slowing the R.P.M. s of one super turbine and/or increasing the R.P.M.s of the other/s. Tests may show that propulsion system may have maneuverability advantages over other forms of propulsion.

The applications for this technology are diverse. Because the wings contact ratio to the sweep many times that of traditional propeller air and watercraft engine it's efficiently and thrust may also prove to be greater. Consequently this "green energy" technology may lower the cost of transportation time and fuel consumption.

Onboard Power Transmission and Power Train E.M.S and E.D.S. Linear Motor Drive Train A100 is powered by a manmade source. The onboard power source powering the A100 and A200 in the example above have been centrally transmitted to the central driveshaft 7 rotating the joined interplanetary hub assembly A102 around A103's inter-stationary sun gear 6. The power transfer thus described focuses almost exclusively on using conventional mechanical gearing and flat belts to rotate the central drive shaft 7 and joined interplanetary hub assembly 102.

Alternatively the power transfer could be transmitted inwardly from concentric drive rims surrounding A100's circular sweep area using the electromagnetic suspension or electro dynamic suspension of maglev techniques to drive electromagnets, linear motors, servo, or related electromagnetic (E.M.S.) and electronic-dynamic technologies (E.D.S) and mechanism known in prior art with transmitted power often controlled with computerized positioning regulator.

In FIG. 2A at the upper left of the Figure in the upper or lower rim of disk 103 of super structure A 103 surrounding the rotational circumference of the planetary turbines are electro magnets power transfer multi track rim 36 transferring regulated charges to rim 29 driving each perimeter 101 of planetary turbine multi rim 3 magnets 37 regulating the one to one counter rotating gear ratio of the two assemblies A102 and A101.

Figure 19A:
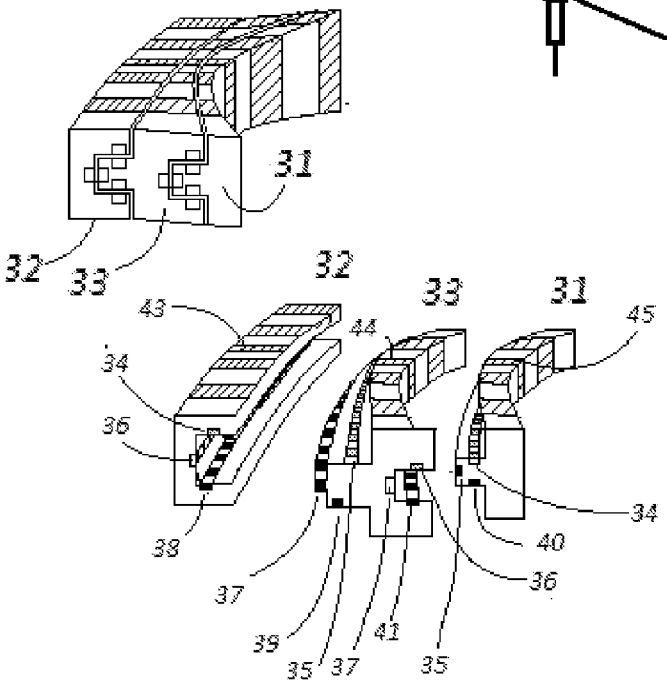
FIG. 19A—Parts detail of electromagnetic inter-stationary multi track rim 32, electromagnetic multi track interface 33 and planetary multi track magnetic rim 31.
Figure 19B:
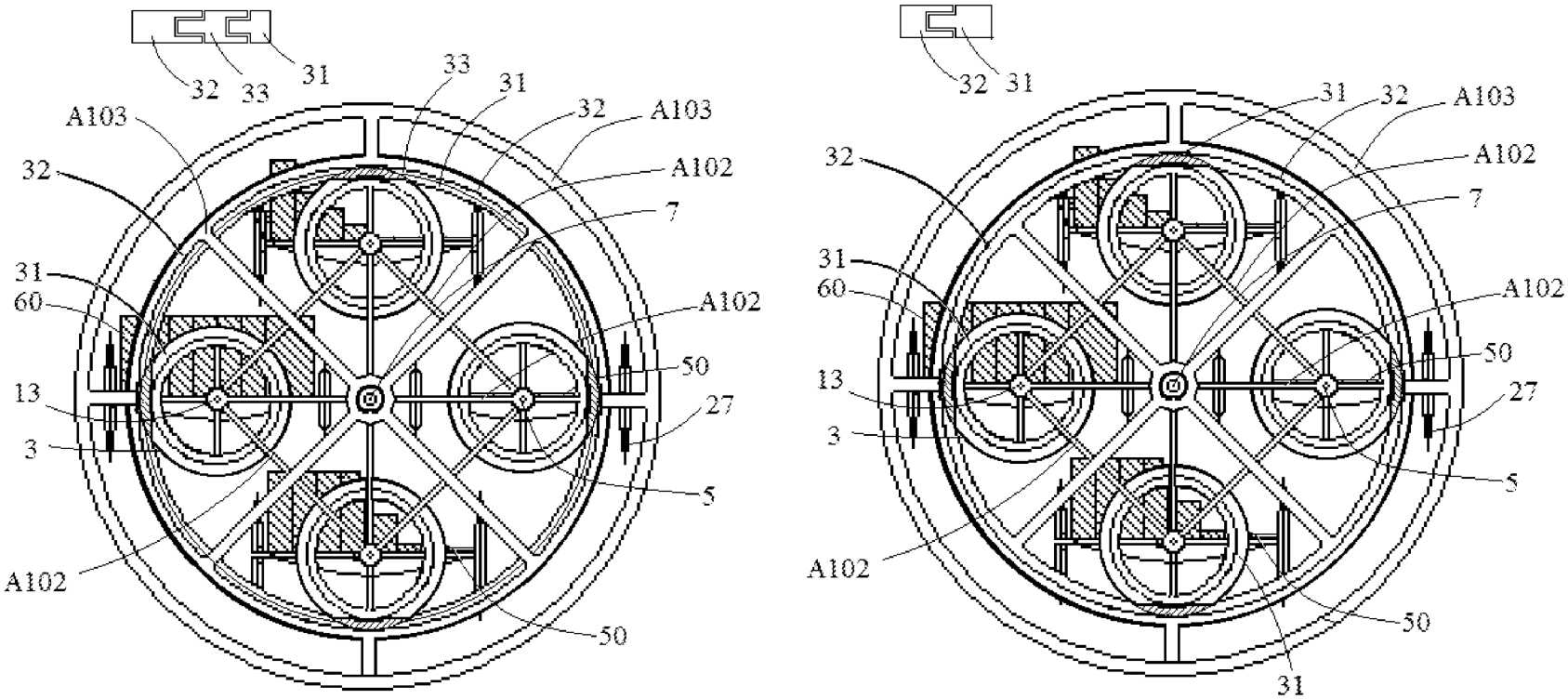
FIG. 19B—Left image of A100 with E/mag. "U" rail 32, floating "Y" rail 33 and "T" rail 31. Right image of A100 with E/mag. "U" rail 32 and "T" rail 31.

In the design seen in the cross section seen in FIG. 19A track 36 seen in FIG. 2A becomes one of many tracks in the multi electromagnetic tracks on "U" rail 32 that is concentrically joined to the inner side of the end disc structure 103 of inter stationary superstructure A103. Electromagnets on "U" rail 32 transfers power through rotating floating interface "Y" rail 33. Interface 33 has an outer curvature matching the curvature of rail 32 joined to 103 and an inner curvature matching the outer "T" curvature of multi magnetic rail 31 joined around the circular perimeter of end assembly 25 on planetary turbines A101. Electromagnetic rim "U" rail 32, floating interface "Y" rail 33 and magnetic rim "T" rail 31 are so constructed, charged, and regulated to electromagnetically maintain the one to one counter rotation of A102 and A101 described above. The above arrangement is seen in FIG. 19B in the image of an A100 on the left of the Figure. At the upper left of that image is a cross section of 'U' rail 32, "Y" rail 33, and "T" rail 31 also seen in the cut out section in FIG. 19A.

An alternative design is seen in FIG. 19B in the image of an A100 on the right with a cross section of the "U" rail 32 and "T" rail seen at its upper left. In this design interface "Y" rail 33 is eliminated and instead the inter-stationary multi track "U" rail 32 interfaces directly with multi track "T" rail 31. Note: The Interface of 31 with 32 is crosshatched showing the overlap of the two assemblies. The shape of the rim rail "U" and rail "T" could be reversed.

With the advances in mechatronics and electromagnetic and electro dynamic suspension frictionless bearing can be incorporated in the pivot shafts and the wing and it drive and glide stops positioned on the frame or drive-stop accelerator 40 can limit and stop pivot rotation using electromagnetic suspension techniques creating nearly frictionless machines with all moving parts suspended and all centrifugal forces of rotation and trajectory counter opposed.

Figure 20:
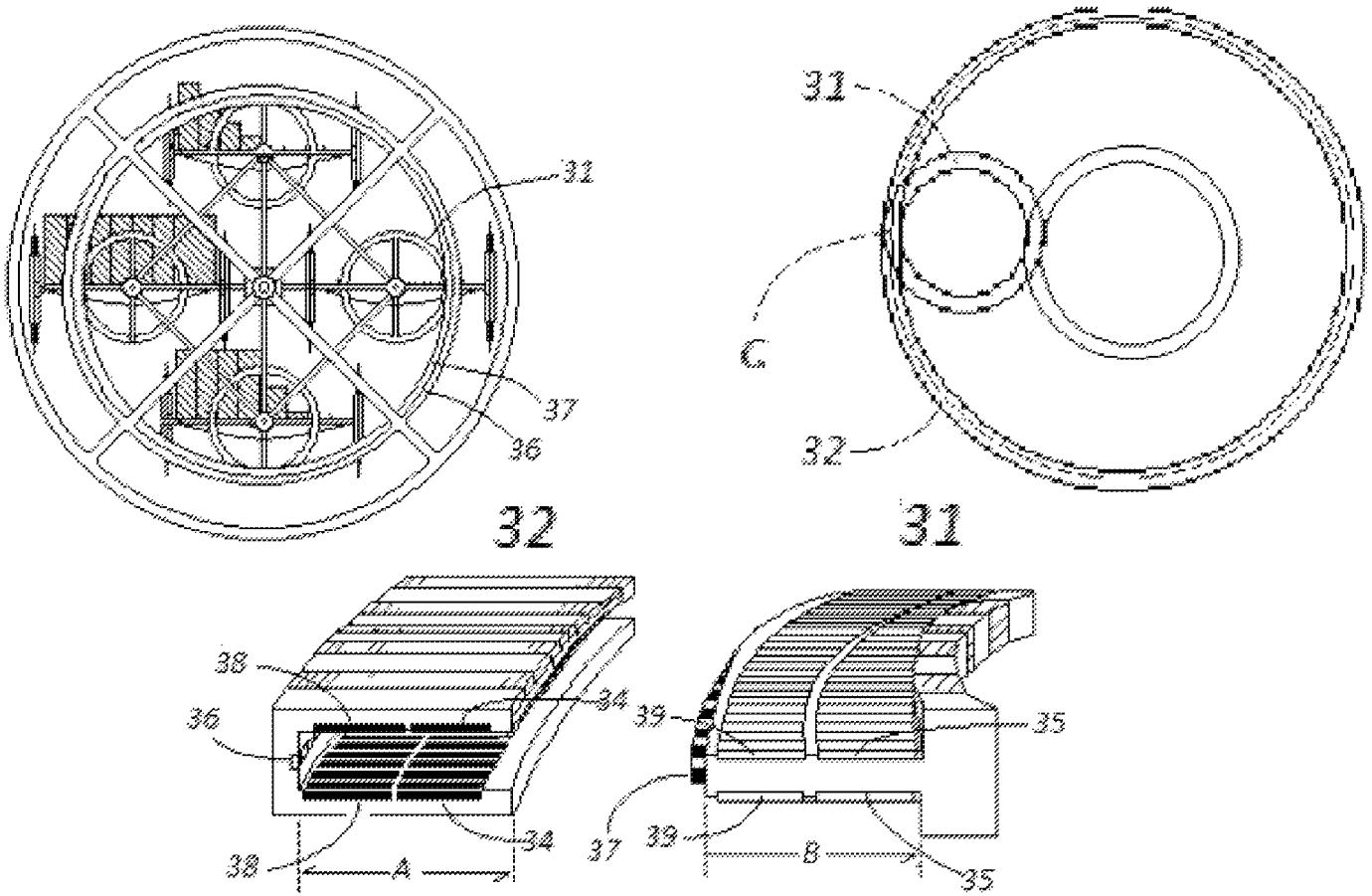
FIG. 20—Matching electromagnetic multi track "U" rail 32 and magnetic multi track "T" rail 31 of A100 on the right side FIG. 19B FIG. 21—Perspective view of A100 with Type "two" planetary turbines A101.

In FIG. 20 Is seen a detail of electromagnetic multi track "U" rail 32 and multi magnetic track "T" rails 31. Each rim "T" rail 31 and "U" rail 32 contain a plurality of matching opposed tracks. In this example tracks 34 or 35 are used for rotational vertical stability 36 or 37 for rotational horizontal stability with rotational opposed electromagnetic rotational driving magnets on tracks 38 and 39 for rotation. In this design planetary turbine's rim track "T" rail 31 with magnets are rotated and regulated by electromagnets in 103's inter-stationary rim track "U" rail 32. In this design all rotating rim magnets in "T" rails 31 around each hub structure 101 are dynamically regulated and controlled simultaneously in their respective positions throughout the plurality of planetary turbines creating a stable system at higher RPM. The opposed track for vertical and horizontal stability also regulate and counter the effects of the centrifugal forces of each assemblies rotation, change of direction of travel, intake and discharge and trajectory.

Using method of cooled electromagnetic transmission there is little if any technological limitations related to heat or friction. With the use of super conductivity technology, very fast revolving and efficient machines may be produced. For example the transmission power source driving the turbines could be monitored and controlled by onboard computerized regulating positioning technologies and transferred electro magnetically inward by electro magnets as described above or used to regulate and power servo motors.

The foregoing description of the preferred embodiments of the invention has been presented for the purpose of illustration and description. It is not intended to be exhaustive or to limit the invention to the precise form disclosed, and many modifications and variations are possible in light of the above teaching without deviating from the spirit and the scope of the invention. The embodiment described is selected to best explain the principle of the invention and its practical application to thereby enable another skilled in the art to best utilize the invention in various embodiments and with various modification as suited to the particular purpose contemplated. It is intended that the scope of the invention be defined by the claims appended hereto.

What is claimed is:

1. A turbine assembly for converting rotational movement into thrust comprising:

a central drive shaft assembly rotatable about a central axis;

a superstructure frame a pair of end disk assemblies about said central drive shaft and parallel to each other defining operating space between them;

sun gear rigidly attached to said superstructure frame;

an interplanetary hub assembly disposed within said operating space and rigidly attached concentrically to said central drive shaft, said interplanetary hub assembly comprising a pair of end hub assemblies disposed parallel to each other;

a plurality of planetary turbine structures, each rotatably attached to both end hub assemblies and rotatable about respective planetary axes; a plurality of pivot shafts, supported on said planetary turbine structures by bearing means, each of said pivot shafts having a respective pivot axis extending longitudinally therethrough;

each planetary turbine structure further comprising a planetary gear said planetary gear being in geared communication with said sun gear such that when the interplanetary hub assembly is rotated one revolution about the central axis, each turbine structure is counter-rotated one revolution with respect to said planetary hub assembly and remains rotationally stationary with respect to the superstructure frame;

a plurality of wings secured to said pivot shafts, each of said wings secured to an end portion of each of said pivot shafts, each of said wings extending in planes that pass through the respective pivot axis of their respective pivot shaft; said plurality of pivot shafts comprising paired pivot shafts extending in parallel relationship, one of said plurality of wings extending from each of said adjacent end portions of said paired pivot shafts and defining an adjacent pair of wings;

said paired pivot shafts being reciprocally rotatable about their respective pivot axes from a drive position in which said adjacent pair of wings extend generally into a plane passing through said planetary axis and said pivot axes, to a glide position in which said adjacent pair of wings extend generally transverse to said plane.

2. The turbine assembly of claim 1 wherein each of said end hub assemblies comprises a plurality of evenly spaced spoke like arms radiating from center of said hub.

3. The turbine assembly of claim 2 wherein at least one of said end hub assemblies. further comprises cross braces connecting each of said spoke like arms.

4. The turbine assembly of claim 1 further comprising means for limiting the rotation of said pivot shafts to less than 90° thereby limiting the deployment of the wings.

5. The turbine assembly of claim 1 wherein the respective pivot axes of each of said paired pivot shafts are substantially parallel to said end hub assemblies and said paired pivot shafts are proximately located approximately midway between said end hub assemblies.

6. The turbine assembly of claim 1 wherein the respective pivot axes of each of said paired pivot shafts are substantially parallel to said end hub assemblies and said paired pivot shafts are distally located with one of each of said paired pivot shafts located proximate to one of the end hub assemblies of each planetary turbine and the other of each of said paired pivot shafts located proximate to the other of the end hub assemblies of the respective planetary turbine.

7. The turbine assembly of claim 1 wherein the respective pivot axes of each of said paired pivot shafts are substantially perpendicular to said end hub assemblies and said paired pivot shafts are proximately located near the planetary axis.

8. The turbine assembly of claim 1 wherein the respective pivot axes of each of said paired pivot shafts are substantially perpendicular to said end hub assemblies and said paired pivot shafts are distally located near the circumference of said end hub assemblies.

9. A turbine assembly for converting rotational movement into thrust comprising:

a central drive shaft assembly rotatable about a central axis;

a superstructure frame comprising a pair of end disk assemblies disposed rotatably about said central drive shaft and parallel to each other defining operating space between them;

an interplanetary hub assembly disposed within said operating space and rigidly attached concentrically to said central drive shaft, said interplanetary hub assembly comprising a pair of end hub assemblies disposed parallel to each other;

a plurality of planetary turbine structures, each rotatably attached to both end hub assemblies and rotatable about respective planetary axes; a plurality of pivot shafts, supported on said planetary turbine structures by bearing means, each of said pivot shafts having a respective pivot axis extending longitudinally therethrough; means for counter rotating each planetary turbine structure one revolution with respect to said interplanetary hub assembly when the interplanetary hub assembly is rotated one revolution about the central axis;

a plurality of wings secured to said pivot shafts, each of said wings secured to an end portion of each of said pivot shafts, each of said wings extending in planes that pass through the respective pivot axis of their respective pivot shaft; said plurality of pivot shafts comprising paired pivot shafts extending in parallel relationship, one of said plurality of wings extending from each of said adjacent end portions of said paired pivot shafts and defining an adjacent pair of wings;

said paired pivot shafts being reciprocally rotatable about their respective pivot axes from a drive position in which said adjacent pair of wings extend generally parallel to said planetary axis and, to a glide position in which said adjacent pair of wings extend generally transverse to said planetary axis.

10. The turbine assembly of claim 9 wherein each of said end hub assemblies comprises a plurality of evenly spaced spoke like arms radiating from the center of said hub.

11. The turbine assembly of claim 10 wherein at least one of said end hub assemblies further comprises cross braces connecting each of said spoke like arms.

12. The turbine assembly of claim 9 further comprising means for limiting the rotation of said pivot shafts to less than 90° thereby limiting the deployment of the wings.

13. The turbine assembly of claim 9 wherein the respective pivot axes of each of said paired pivot shafts are substantially parallel to said end hub assemblies and said paired pivot shafts are proximately located approximately midway between said end hub assemblies.

14. The turbine assembly of claim 9 wherein the respective pivot axes of each of said paired pivot shafts are substantially parallel to said end hub assemblies and said paired pivot shafts are distally located with one of each of said paired pivot shafts located proximate to one of the end hub assemblies of each planetary turbine and the other of each of said paired pivot shafts located proximate to the other of the end hub assemblies of the respective planetary turbine.

15. The turbine assembly of claim 9 wherein the respective pivot axes of each of said paired pivot shafts are substantially perpendicular to said end hub assemblies and said paired pivot shafts are proximately located near the planetary axis.

16. The turbine assembly of claim 9 wherein the respective pivot axes of each of said paired pivot shafts are substantially perpendicular to said end hub assemblies and said paired pivot shafts are distally located near the circumference of said end hub assemblies.

* * * * *